US006809691B2

(12) United States Patent
Yamamoto et al.

(10) Patent No.: US 6,809,691 B2
(45) Date of Patent: Oct. 26, 2004

(54) DIRECTIVITY CONTROLLABLE ANTENNA AND ANTENNA UNIT USING THE SAME

(75) Inventors: Atsushi Yamamoto, Osaka (JP); Hiroshi Iwai, Katano (JP); Koichi Ogawa, Hirakata (JP)

(73) Assignee: Matsushita Electric Industrial Co., Ltd., Osaka-Fu (JP)

( * ) Notice: Subject to any disclaimer, the term of this patent is extended or adjusted under 35 U.S.C. 154(b) by 46 days.

(21) Appl. No.: 10/405,605

(22) Filed: Apr. 3, 2003

(65) Prior Publication Data

US 2003/0189521 A1 Oct. 9, 2003

(30) Foreign Application Priority Data

Apr. 5, 2002 (JP) ..... 2002-104064

(51) Int. Cl.[7] ..... H01Q 1/24
(52) U.S. Cl. ..... 343/702; 343/789
(58) Field of Search ..... 343/702, 789, 343/853, 700 MS

(56) References Cited

U.S. PATENT DOCUMENTS 5,828,346 A * 10/1998 Park ..... 343/826
6,075,491 A * 6/2000 Dakeya et al. ..... 343/722
6,211,830 B1 * 4/2001 Monma et al. ..... 343/702
6,392,605 B2 * 5/2002 Anterow ..... 343/702
6,639,559 B2 * 10/2003 Okabe et al. ..... 343/700 MS

FOREIGN PATENT DOCUMENTS

JP 9-135115 5/1997
JP 2001-308630 11/2001

* cited by examiner

*Primary Examiner*—Don Wong
*Assistant Examiner*—Huedung X. Cao
(74) *Attorney, Agent, or Firm*—Wenderoth, Lind & Ponack, L.L.P.

(57) ABSTRACT

A top conductor 11, a ground conductor 12, and side conductors 13 form an antenna box having two openings 22 and 23. Antenna elements 14 and 15 are placed inside of the antenna box, and are connected to power supply points 16 and 17, respectively. A power supply control circuit 20 has a switching function of connecting either one of the power supply points 16 and 17, to an external connecting terminal 21. Depending on the antenna element 14 or 15 being operated, the antenna has a directivity biased to a desired direction. The power supply control circuit 20 may have a signal combining/separating function, a phase shifter 26, or an amplitude adjusting circuit 27. With this, it is possible to provide a small, slim antenna capable of biasing the directivity to a desired direction and controlling the directivity even after installation.

32 Claims, 29 Drawing Sheets

DIRECTIVITY CONTROLLABLE ANTENNA AND ANTENNA UNIT USING THE SAME

BACKGROUND OF THE INVENTION

1. Field of the Invention

The present invention relates to an antenna and an antenna unit both for use mainly in mobile communications. More specifically, the present invention relates to an antenna for a base station in mobile communications, and an antenna unit using the antenna.

2. Description of the Background Art

With reference to FIGS. 36 through 40, one example of a conventional antenna is described below. FIG. 36 is an illustration showing the configuration of a monopole antenna described in Japanese Patent Laid-Open Publication No. 2001-308630. The antenna includes a top conductor 111, a ground conductor 112, side conductors 113, an antenna element 114, and a power supply point 115. The antenna has a feature of having bi-directional directivity on a horizontal plane. The top conductor 111 has there parts 111*a,* 111*b,* and 111*c,* with the part 111*b* located at the center of the conductor 111 being implemented by a linear conductor. The top conductor 111, the ground conductor 112, and the side conductors 113 form an antenna box having the shape of a rectangular parallelepiped. The antenna box has two openings 116 and 117 on the top. The power supply point 115 is located at the center of the ground conductor 112. The antenna element 114 is connected at one end to the power supply point 115. Furthermore, the antenna element 114 is mechanically or electrically connected at the other end to the center point of the ground conductor 111*b* by, for example, soldering. When a coordinate system is set as illustrated in FIG. 36 by taking the power supply point 115 as an origin, the antenna has a symmetric structure with respect to both of a Z-Y plane and a Z-X plane.

With reference to FIG. 37, the operation of the antenna illustrated in FIG. 36 is described below. Excitation of electric waves occurs at the antenna element 114, from which an electric wave having a frequency of f0 is emitted. The electric waves are emitted through two openings 116 and 117 to the outside of the antenna box. These two openings 116 and 117 are located symmetrically to the antenna element 114, which is an emitting source. Therefore, the distance from the antenna element 114 to the opening 116 is equal to the distance from the antenna element 114 to the opening 117. Also, as illustrated in FIG. 37A, the direction of the electric field excited at the opening 116 is opposed to the direction thereof excited at the opening 117. Here, for the sake of convenience in description, consider a case in which the electric fields excited at these openings 116 and 117 are replaced by magnetic flows. In this case, as illustrated in FIG. 37B, it can be assumed that two linear magnetic flow sources B1 and B2 are located at the openings 116 and 117, respectively, in parallel to the Y axis. These linear magnetic flow sources B1 and B2 have the same amplitude, but are oriented to opposite directions. Here, the electric waves emitted from the antenna can be considered as being emitted from these two magnetic flow sources B1 and B2. That is, emission from the antenna can be regarded as emission from an array of the magnetic flow sources B1 and B2.

As illustrated in FIG. 37B, the magnetic flow sources B1 and B2 are located symmetrically with respect to the Z-Y plane. For this reason, the electric waves emitted from the magnetic flow sources B1 and B2 are equal in amplitude and opposite in phase to each other on the Z-Y plane, and therefore are cancelled by each other. With this, no electric wave is emitted on the Z-Y plane. On the Z-X plane, the electric waves emitted from the magnetic flow sources B1 and B2 are equal in phase to each other in one direction. In that direction, the electric wave from the antenna is intensified. For example, when an interval between the magnetic flow sources B1 and B2 is ½ a wavelength in free space, two electric waves are equal in phase to each other at an arbitrary point on the X axis. Therefore, the electric wave from the antenna is intensified in both of the +X direction and the −X direction. That is, the antenna illustrated in FIG. 36 has a bi-directional directivity in the X direction.

As such, according to the antenna illustrated in FIG. 36, an effect of an antenna array can be achieved only by a single antenna element, and a directivity can be provided to the antenna. Furthermore, when the openings 116 and 117 are made longer in the Y direction, for example, the magnetic flow sources also become longer. Therefore, emission in the X direction is reduced, thereby producing larger gain. As such, gain can be adjusted depending on the length of the openings.

In general, the size of conductive members that construct the antenna is finite. Therefore, the electric wave is diffracted at the end portion of each conductive member. Therefore, precisely speaking, the electric wave emitted from the antenna is a sum of an electric wave emitted from the antenna element and diffracted waves at the end portions of the respective conductive members. The same goes for the antenna illustrated in FIG. 36. That is, the electric wave is diffracted at every end portion and every refraction point of the conductors 111, 112, and 113. Particularly, since the top conductor 111 and the openings 116 and 117 are located on a same plane, the electric wave emitted from the antenna is greatly influenced by a diffracted wave at the end of the top conductor 111. Thus, the directivity of the antenna illustrated in FIG. 36 is varied by the number or locations of the openings 116 and 117 as well as the size and shape of the conductors 111, 112, and 113.

By way of example only, the characteristics of a prototype antenna illustrated in FIG. 38 are described. In FIG. 38, when a free space wavelength of λ0 is taken as a reference, the ground conductor 112 is shaped like a square whose side is 0.836×λ0 each, and the height of each side conductor 113 is 0.0836×λ0. The top conductor 111*b* at the center is a linear conductor being located in parallel to the Y axis and having a length of 0.836×λ0. Both ends of the top conductor 111*b* are electrically connected to the side conductors 113. The top conductors 111*a* and 111*c* are each shaped like a rectangle having two sides each being parallel to the X axis and having a length of 0.209×λ0 and the other two sides each being parallel to the Y axis and having a length of 0.836×λ0. These top conductors 111*a* and 111*c* are connected to the side conductors 113. The two openings 116 and 117 are also each shaped like a rectangle having two sides each being parallel to the X axis and having a length of 0.209×λ0 and the other two sides each being parallel to the Y axis and having a length of 0.836×λ0. These openings 116 and 117 are located adjacently to each other so as to sandwich the conductor 111*b* therebetween. Therefore, the antenna box has a symmetric structure with respect to both of a Z-Y plane and a Z-X plane. The antenna element 114 is a linear conductor having the element length of 0.0835×λ0. One end of the antenna element 114 is electrically connected to the midpoint of the top conductor 111*b*.

FIG. 39 is a graph showing VSWR (Voltage Standing Wave Ratio) characteristics with respect to a power supply line of 50Ω as input impedance characteristics of the prototype antenna illustrated in FIG. 38. In FIG. 39, the horizontal axis represents frequencies standardized with a center frequency of f0. Frequencies of f1 and f2 are a minimum frequency and a maximum frequency, respectively, both of whose VSWR is 2 or less. According to FIG. 39, a frequency band whose VSWR is 2 or less is $((f2-f1)/f0)=18.2\%$. Therefore, the prototype antenna illustrated in FIG. 38 has improved impedance characteristics with less reflection loss over a wide band.

FIG. 40 is an illustration showing an mission directivity of the prototype antenna illustrated in FIG. 38 at the center frequency of f0. In the drawing, a scale of the radiation directivity is in units of 10 dB and its unit is dBi with reference to emission power of a point wave source. As can be seen from FIG. 40, the antenna illustrated in FIG. 38 suppresses emission of an electric wave in the Y direction, and has a bi-directional directivity in the X direction. Therefore, this antenna can outstanding characteristics in a long interior space, such as a corridor.

Moreover, the height of the antenna element 114 of the prototype antenna is $0.0835\times\lambda 0$, which is lower than the height of a normal ¼-wavelength antenna element. Therefore, even when the antenna cannot be embedded in a ceiling, the antenna does not protrude much from the ceiling, and is thus inconspicuous. For this reason, this antenna does not disturb the outer look of the ceiling, and therefore is preferable. Also, the antenna box has a symmetric structure with respect to a predetermine plane. Therefore, the directivity of the antenna can be symmetrical to that plane. As described above, it is possible to achieve a high-performance antenna having a desired bi-directional directivity with a small and simple structure.

The above-described conventional antenna, however, has a drawback that its directivity cannot be biased to a specific direction. That is, the conventional antenna has a bi-directional directivity on a horizontal plane, and is suitable for covering a long-shaped space, such as a corridor, but does not have a directivity biased to a specific direction. This poses a problem when the antenna is used in a room, for example. Now consider a case in which an antenna is placed between a receiver of a communications system and another communications system, and the frequency used by the former communications system is close to that used by the latter communications system. In this case, an electric wave emitted from the antenna to the receiver of the former communications system is an interfering wave to the latter communications system. Therefore, power of the electric wave emitted from the antenna is required to be small, to some extent. With the power of the emitted electric wave being small, however, the electric wave received by the receiver also becomes small, thereby causing a communicable area to be narrowed. For this reason, the conventional antenna incapable of biasing the direction of emitting an electric wave is not adequate in an environment in which a plurality of systems using frequency bands close to each other are closely located to each other (in a room, for example).

Furthermore, the conventional antenna has another drawback that its directivity is fixed. That is, since the directivity of the antenna is determined based on the shape of the antenna and the frequency to be used, the directivity of the antenna cannot be changed after the antenna is installed unless the antenna is reoriented. However, when a communications system is installed in a place close to an antenna that has already been installed, the directivity of the antenna that has already been installed may be desired to be changed in some cases. Moreover, if the directivity of the antenna can be dynamically controlled based on a receiver's location varying with time, highly-reliable communications with less noise can be achieved by making the most of the characteristics of the antenna.

SUMMARY OF THE INVENTION

Therefore, an object of the present invention is to provide an antenna capable of biasing a bi-directional radiation directivity to a desired direction and controlling the directivity after installment, and an antenna unit using the antenna.

The present invention has the following features to attain the object mentioned above.

A first aspect of the present invention is directed to an antenna with a directivity, including: a ground conductor; at least two power supply sections placed on a surface of the ground conductor; at least two antenna elements connected one-to-one to the power supply sections; a top conductor opposed to the ground conductor across the antenna elements; side conductors surrounding a space including the antenna elements, being located apart from the antenna elements, and forming, together with the top conductor and the ground conductor, an antenna box having at least two openings; and a power supply control section for controlling signals passing through between an external connecting terminal and the power supply sections. According to the first aspect, it is possible to provide a small, slim, simply-structured antenna capable of biasing the directivity to a desired direction and controlling the directivity even after installation.

In this case, the power supply control section may switch the power supply sections for connection to the external connecting terminal. With this switching function, the directivity of the antenna can be biased to a specific direction, and also be controlled after installation.

Furthermore, the power supply control section may have at least either one of a function of combining signals supplied by the power supply sections for output to the external connecting terminal and a function of separating a signal supplied through the external connecting terminal for output. With such signal combining/separating function, the directivity of the antenna can be biased to a specific direction, and also be controlled after installation.

Still further, the power supply control section may include a phase adjusting section for changing a phase of the signal or an amplitude adjusting section for changing an amplitude of the signal, which is located at a point on a route from the external connecting terminal to one of the power supply sections. As such, by using the phase adjusting section or the amplitude adjusting section, the phase or amplitude of each of the signals of the antenna elements is appropriately adjusted. With this, the directivity of the antenna can be biased to a specific direction, and also be controlled after installation.

Still further, only one said top conductor may be provided to the antenna. Also, all of the antenna elements may be placed in a space between the top conductor and the ground conductor. As such, signals supplied to the antenna elements are controlled by using the power supply control section. With this, the characteristics of electric waves emitted from two or more openings formed on the antenna box can be switched. Moreover, the directivity of the antenna can be biased to a specific direction, and also be controlled after installation.

Still further, at least two of said top conductors may be provided to the antenna. Also, and each of the antenna elements may be placed in a space between each of the top conductors and the ground conductor. As such, signals supplied to the antenna elements are controlled by using the power supply control section. With this, the characteristics of electric waves emitted from two or more openings formed on the antenna box can be switched. Moreover, the directivity of the antenna can be biased to a specific direction, and also be controlled after installation. Still further, the top conductor is provided to each of the antenna elements. Therefore, when one antenna element is selected for operation, the top conductor(s) of the other antenna element (s) acts as a reflector(s). Thus, the directivity of the antenna can be further biased to a specific direction.

Still further, the top conductor and the antenna elements may be electrically connected to each other. With such electrical connection, the impedance of the antenna can be stabilized. Therefore, the characteristics of the antenna can also be stabilized.

Still further, the antenna box, and shapes and locations of the openings may be symmetrical with respect to a first plane which is perpendicular to the ground conductor. With this, the directivity of the antenna can be made symmetrical with respect to the first plane.

In this case, the power supply sections may be placed symmetrically with respect to the first plane. With this, when the power supply sections are connected to the antenna elements, these antenna elements are placed symmetrically with respect to the first plane. Therefore, the directivity of the antenna can be made symmetrical with respect to the first plane.

Still further, the antenna box, and shapes and locations of the openings may be symmetrical with respect to a second plane which is perpendicular to both of the ground conductor and the first plane. With this, the directivity of the antenna can be made symmetrical with respect to the second plane.

In this case, the power supply sections may be placed symmetrically with respect to the first plane and the second plane. With this, when the power supply sections are connected to the antenna elements, these antenna elements are placed symmetrically with respect to the first and second planes. Therefore, the directivity of the antenna can be made symmetrical with respect to the first and second planes.

Alternatively, the ground conductor can be in a shape of a rectangle. With this, it is possible to install the antenna on a ceiling, for example, so as to conform to squares often designed on the ceiling or the shape of a room in order to prevent the antenna from being conspicuous.

Still alternatively, the ground conductor can be in a circular-like shape. With this, it is possible to install the antenna on a ceiling, for example, in a desired direction irrespectively of the squares often designed on the ceiling or the shape of the room.

Still further, the antenna may further include at least one matching conductor which is accommodated in the antenna box, is electrically connected to the ground conductor, and is placed apart from the antenna elements. In this case, at least one matching conductor may be electrically connected to the antenna elements or the top conductor. With the matching conductor being provided, it is possible to match the impedance of each antenna element and the impedance of each power supply line, thereby efficiently supplying power.

Still further, the antenna may further include at least one isolation adjusting conductor which is accommodated in the antenna box and is connected at one end to the ground conductor. In this case, at least one isolation adjusting conductor is connected to the top conductor. With this, it is possible to provide an antenna having desired isolation characteristics and capable of controlling the radiation directivity.

Still further, the antenna may further include a dielectric material which is accommodated in the antenna box, and the dielectric material has a dielectric constant higher than a dielectric constant of air. With this, the wavelength is reduced in the dielectric material. Therefore, the antenna can be made smaller and slimmer without deteriorating the characteristics, such as the directivity.

In this case, the antenna box may be entirely filled with the dielectric material. With this, air full of dust or moisture can be prevented from entering inside of the antenna box. Therefore, deterioration in antenna characteristics due to such air can be prevented.

Still further, the top conductor and the ground conductor may be formed by metal foils laminated to a dielectric plate, and the side conductors are formed with via holes. By manufacturing an antenna with the use of a plate processing technology such as etching, the accuracy in manufacturing the antenna can be improved. Also, cost incurred in mass production of antennas can be reduced.

Alternatively, the dielectric material may occupy part of the inside of the antenna box, and may cover the openings. With the openings being covered by the dielectric material, air full of dust or moisture can be prevented from entering inside of the antenna box. Therefore, deterioration in antenna characteristics due to such air can be prevented.

Still further, the antenna may further include an opening control section for changing a size of at least one of the openings. By changing the size of the opening, the radiation directivity of the antenna can be changed. Also, by combining a control of the radiation directivity by the opening control section and a control thereof by the power supply control circuit section, it is possible to easily achieve a desired radiation directivity.

Still further, the power supply control section may be placed on the ground conductor inside of the antenna box. With this, the antenna can be made small.

In this case, the antenna may further include a shield material made of metal which is accommodated in the antenna box. Also, the power supply control section may be placed in a space shielded by the ground conductor and the shield material. With this, the antenna can be made small. Also, it is possible to reduce the influence of electric fields occurring inside of the antenna box on the operation of the power supply control section.

Still further, the ground conductor may have a concave portion oriented inwardly to the antenna box. Also, the power supply control section may be placed in the concave portion of the ground conductor outside of the antenna box. With this, the antenna can be made small. Also, it is possible to reduce the influence of electric fields occurring inside of the antenna box on the operation of the power supply control section.

In this case, the antenna may further include a shield material made of metal which covers the concave portion of the ground conductor. Also, the power supply control section may be placed in a space shielded by the concave portion of the ground conductor and the shield material. With this, the antenna can be made small. Also, it is possible to reduce the influence of electric fields occurring inside of the antenna box on the operation of the power supply control section.

A second aspect of the present invention is directed to an antenna unit including an antenna with a directivity, including: a ground conductor; at least two power supply sections placed on a surface of the ground conductor; at least two antenna elements connected one-to-one to the power supply sections; atop conductor opposed to the ground conductor across the antenna elements; side conductors surrounding a space including the antenna elements, being located apart from the antenna elements, and forming, together with the top conductor and the ground conductor, an antenna box having at least two openings; a power supply control section for controlling signals passing through between an external connecting terminal and the power supply sections; and a radio circuit for supplying the antenna connecting terminal with a radio signal received from an antenna control device externally provided, and transmitting a radio signal output from the antenna connecting terminal to the antenna control device. With this, it is possible to provide an antenna unit including a small, slim, simply-structured antenna capable of biasing the directivity to a desired direction and controlling the directivity even after installation.

Still further, the radio circuit may include a converter circuit for converting an optical signal to an electrical signal and an electrical signal to an optical signal, and may perform optical communications with the antenna control device. With this, it is possible to provide an antenna unit including a small, slim, simply-structured antenna capable of biasing the directivity to a desired direction and controlling the directivity even after installation. This antenna unit also enables optical communications with the antenna control device.

Still further, only one said top conductor may be provided to the antenna, and all of the antenna elements may be placed in a space between the top conductor and the ground conductor. Alternatively, at least two of said top conductors may be provided to the antenna, and each of the antenna elements may be placed in a space between each of the top conductors and the ground conductor. As such, signals supplied to the antenna elements are controlled by using the power supply control section. With this, it is possible to provide an antenna unit including an antenna capable of switching the characteristics of electric waves emitted from two or more openings formed on the antenna box. The antenna is also capable of biasing the directivity of the antenna to a desired direction, and controlling the directivity after installation.

These and other objects, features, aspects and advantages of the present invention will become more apparent from the following detailed description of the present invention when taken in conjunction with the accompanying drawings.

DESCRIPTION OF THE PREFERRED EMBODIMENTS (First Embodiment)

Figure 1A:
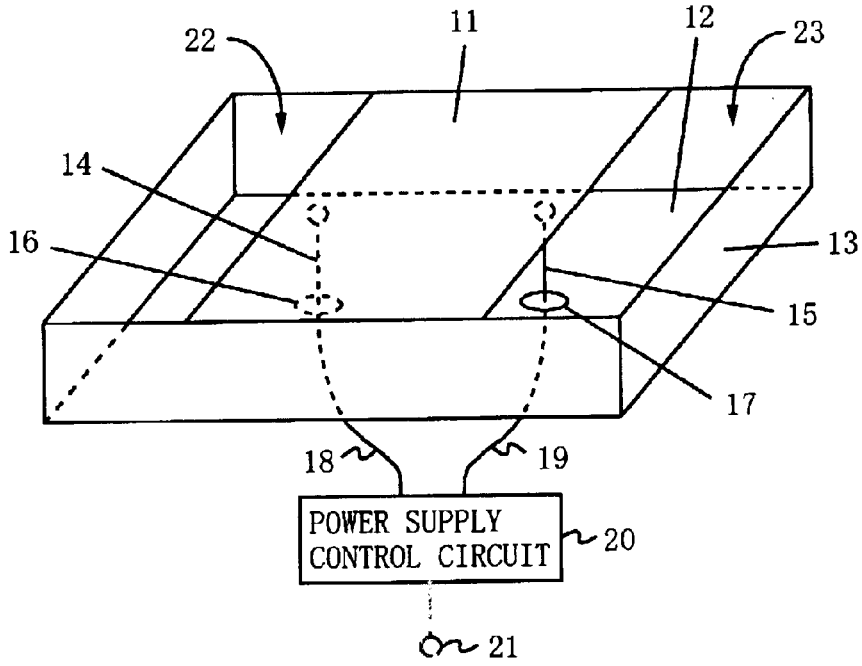
FIGS. 1A and 1B are illustrations exemplarily showing the configuration of an antenna according to a first embodiment of the present invention.
Figure 1B:
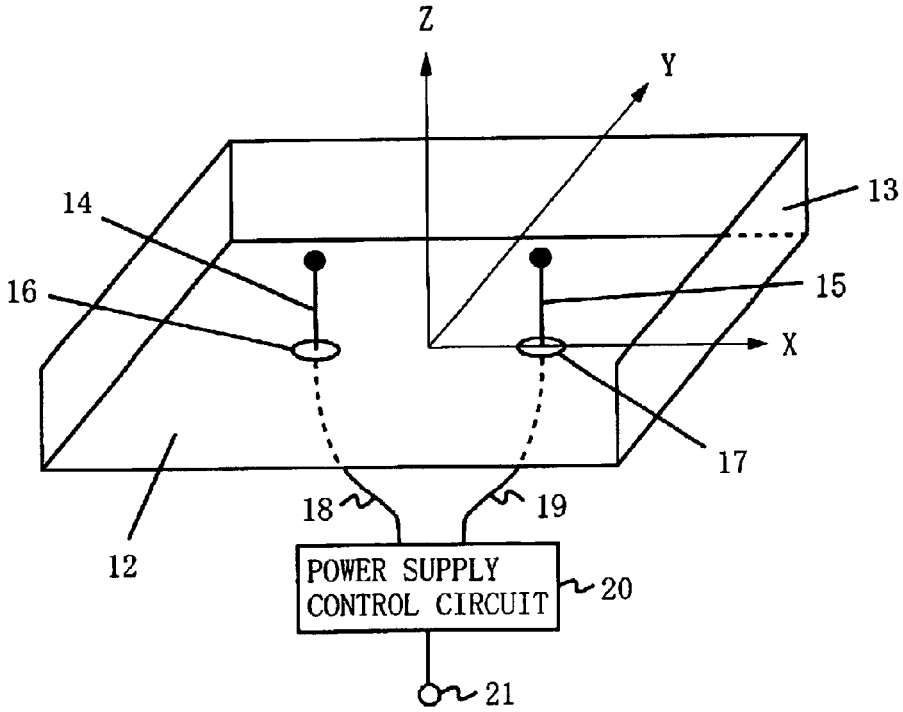

FIGS. 1A and 1B are illustrations showing the configuration of an antenna according to a first embodiment of the present invention. As illustrated in FIG. 1A, the antenna includes a top conductor 11 located at the top of the antenna, a ground conductor 12 located at the bottom thereof, side conductors 13 respectively located at four sides thereof, antenna elements 14 and 15, power supply points 16 and 17 signal lines 18 and 19, a power supply control circuit 20, and an external connecting terminal 21. The top conductor 11, the ground conductor 12, and the side conductors 13 form an antenna box having two openings 22 and 23. This antenna has the following features of: having two antenna elements, two power supply points, and two openings; having a shape that is symmetrical in structure with respect to two planes perpendicular to the ground conductor; the top conductor, the ground conductor, and the openings each having a rectangular shape; and the antenna element being connected to the top conductor. Note that FIG. 1B is a reference illustration showing the antenna illustrated in FIG. 1A having the top conductor 11 and one of the side conductors which is located at the front being removed therefrom. This antenna is typically used by being embedded in or mounted on a ceiling so that an outward facing surface of the ground conductor 12 faces the ceiling.

The ground conductor 12 is a rectangular-shaped conductive plate. For the sake of convenience in description, a coordinate system is set as illustrated in FIG. 1B. That is, a point of intersection of diagonal lines drawn on the ground conductor 12 is taken as an origin. Also, an X axis is set in parallel to two sides of the ground conductor 12, and a Y axis is set in parallel to the other two sides thereof. Further, a Z axis is set in the direction of the normal of the ground conductor 12.

The power supply points 16 and 17 are placed on the surface of the ground conductor 12. In more detail, the power supply points 16 and 17 are placed on the X axis so as to be symmetrical to each other with respect to the origin. The antenna elements 14 and 15 are placed so as to be perpendicular to the ground conductor 12. In other words, the power supply points 16 and 17 are placed symmetrically to each other with respect to the Z-Y plane and the Z-X plane, and also the antenna elements 14 and 15 are placed symmetrically to each other with respect thereto. The antenna elements 14 and 15 are electrically connected at one end to the power supply points 16 and 17 respectively, and at the other end to the top conductor 11 by soldering or the like. The power supply control circuit 20 has two antenna power supply terminals and one external connecting terminal 21. The two antenna power supply terminals are connected to the power supply points 16 and 17 via signal lines 18 and 19, respectively. The external connecting terminal 21 is connected to, for example, a radio circuit (not shown) forming an antenna unit together with this antenna.

The top conductor 11 is a rectangular-shaped conductive plate having two sides equal in length to two sides of the ground conductor 12 and having the other two sides shorter in length than the other two sides of the ground conductor 12. The top conductor 11 is placed so as to be opposed to the ground conductor 12 across the antenna elements 14 and 15. In more detail, the top conductor 11 is placed so as to satisfy the following conditions: 1) the top conductor 11 is parallel to the ground conductor 12; 2) the two sides equal in length to the two sides of the ground conductor 12 are parallel to the Y axis, and the other two sides are parallel to the X axis; and 3) a point of intersection of diagonal lines drawn on the top conductor 11 is located on the Z axis.

The side conductors 13 are composed of four conductive plates, forming the antenna box of a rectangular parallelepiped together with the top conductor 11 and the ground conductor 12. The side conductors 13 are electronically connected to both of the top conductor 11 and the ground conductor 12. The top conductor 11 and the ground conductor 12 are placed so as to satisfy the above-mentioned conditions 1) through 3). Therefore, the antenna box has two openings 22 and 23 that are symmetrical to both of the Z-Y plane and the Z-X plane. Here, as described above, six conductive plates are used to form the antenna box in the present embodiment. Alternatively, one conductive plate in a shape of a developed view of the antenna box can be used.

FIGS. 2A through 2D are illustrations showing the details of the power supply control circuit 20. The power supply control circuit 20 can be implemented by a variety of circuits having different configurations as described below. Power supply control circuits 20*a*, 20*b*, 20*c*, and 20*d* are each provided with two antenna power supply terminals 24 and 25, and one external connecting terminal 21.

Figure 2A:
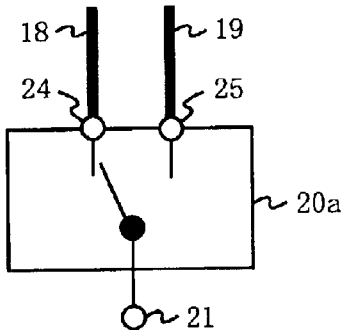
FIGS. 2A through 2D are illustrations showing exemplary configurations of a power supply control circuit in the antenna according to the first embodiment of the present invention.

The power supply control circuit 20*a* illustrated in FIG. 2A has a function of switching between the antenna elements in operation. This power supply control circuit 20*a* connects, in accordance with a control signal (not shown), either one of the two antenna power supply terminals 24 and 25 to the external connecting terminal 21. When the external connecting terminal 21 is connected to the antenna power supply terminal 24, the external connecting terminal 21 is connected to the power supply point 16. With this, the antenna element 14 is operated. When the external connecting terminal 21 is connected to the antenna power supply terminal 25, on the other hand, the external connecting terminal 21 is connected to the power supply point 17. With this, the antenna element 15 is operated.

Figure 2B:
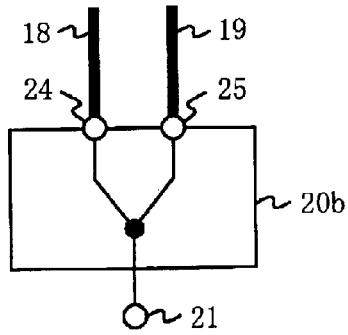

The power supply control circuit 20*b* illustrated in FIG. 2B can combine and separate the power of the antenna elements. This power supply control circuit 20*b* can combine signals supplied through two antenna power supply terminals 24 and 25 for output to the external connecting terminal 21. Also, the power supply control circuit 20*b* can separate a signal supplied through the external connecting terminal 21 into two signals for output to the two antenna power supply terminals 24 and 25. A ratio of signal combination/separation may be fixed, or may be varied based on a control signal (not shown). Note that the above-mentioned switching function can be considered as a combining/separating function in which either 0% or 100% is selectable as the ratio of signal combination/separation.

Furthermore, the power supply control circuit 20 may be provided with a phase shifter or an amplitude adjusting circuit on routes from the antenna power supply terminals 24 and 25 to the external connecting terminal 21. By way of example, two phase shifters 26 are added to the power supply control circuit 20*b* of FIG. 2B, thereby obtaining a power supply control circuit 20*c* illustrated in FIG. 2C. In another case, two amplitude adjusting circuits 27 are further added to the power supply control circuit 20*c* of FIG. 2C, thereby obtaining a power supply control circuit 20*d* illustrated in FIG. 2D. The phase shifters 26 vary the phase of the signal supplied to the antenna, while the amplitude adjusting circuit 27 vary the amplitude thereof. Alternatively, the power supply control circuit 20 can be provided only with the amplitude adjusting circuits 27. Still alternatively, the phase shifter 26 and/or the amplitude adjusting circuit 27 can be provided on either one of the two routes from the antenna power supply terminals 24 and 25 to the external connecting terminal 21.

Figure 3A:
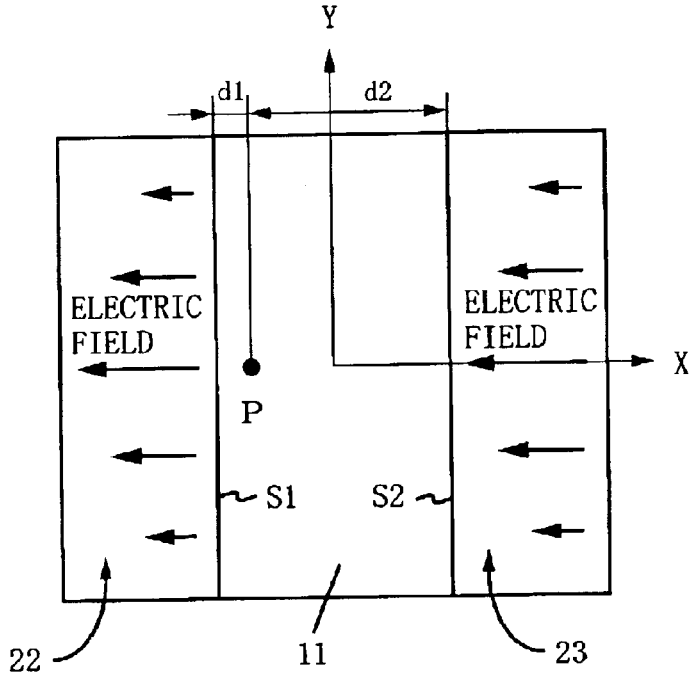
FIGS. 3A and 3B are illustrations showing the operational principle of the antenna according to the first embodiment of the present invention.
Figure 3B:
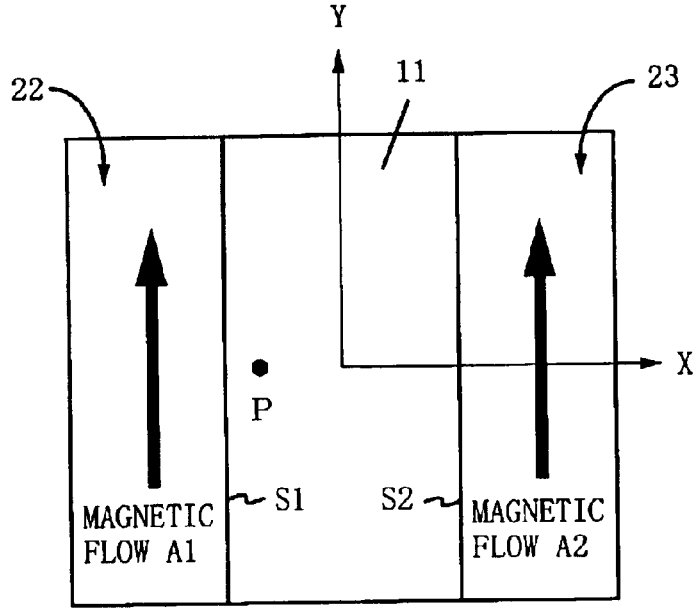

Next, with reference to FIGS. 3A, 3B, 4A, 4B, 5A through 5C, and 6, the operational principle of the antenna illustrated in FIG. 1A is described below. FIGS. 3A and 3B are illustrations showing one example of an electric field distribution and a magnetic flow distribution, with only the antenna element 14 being supplied with a signal and the antenna element 15 being open (not being supplied with a signal). When only the antenna element 14 is supplied with a signal, excitement of an electric wave occurs only at the antenna element 14. As a result, an electric field illustrated in FIG. 3A acts as an emitting source, emitting an electric wave from the two openings 22 and 23.

It is assumed herein that a point of connection between the top conductor 11 and the antenna element 14 is taken as P, and one side of the top conductor 11 close to the opening 22 is taken as S1 while the other side thereof close to the opening 23 is taken as S2. When a distance from the point P to the side S1 is taken as d1, the phase of the electric field occurring between the side S1 and the ground conductor 12 lags behind the antenna element 14 by k0×d1 [rad.]. On the other hand, when a distance from the point P to the side S2 is taken as d2, the phase of the electric field occurring between the side S2 and the ground conductor 12 lags behind the antenna element 14 by k0×d2 [rad.]. Here, k0 is a wave number of free space, and is expressed by using a wavelength of λ0 as 2×π/λ0. Therefore, when the electric fields occurring at the sides S1 and S2 of the top conductor 11 are compared with each other, these electric fields are equal in amplitude to each other, but are different in phase from each other by k0×(d1−d2) [rad.].

Descriptions are now made by replacing the electric fields by magnetic flows. At the two openings 22 and 23, as illustrated in FIG. 3B, two linear magnetic flow sources A1 and A2 exist, respectively, which are parallel to the Y axis and are equal in amplitude to each other but are different in phase from each other by k0×(d1−d2) [rad.]. Here, an electric wave emitted from the antenna is considered as that emitted from the two magnetic flow sources A1 and A2. In other words, electric wave emission from the antenna can be regarded as electric wave emission from these two magnetic flow sources A1 and A2.

For instance, in the example illustrated in FIGS. 3A and 3B, the phase difference between the electric fields are assumed to be π [rad.]. In this case, the direction of the electric field occurring at the opening 22 is the same as the direction thereof occurring at the opening 23 (FIG. 3A). Therefore, the magnetic flow sources A1 and A2 are also oriented in the same direction (FIG. 3B). For this reason, when the phase difference between the electric fields is π [rad.], the antenna illustrated in FIG. 1A can be regarded as an array of two linear magnetic flows which have same phases.

In general, a direction in which an electric wave emitted from an antenna array is intensified is determined based on an array factor defined by the phase difference between electric currents supplied to the antenna elements and the interval between these antenna elements. An electric wave emitted from the antenna array can be obtained by multiplying the array factor by a emission patterns of each antenna element. Therefore, if emission patterns of the linear magnetic flow sources A1 and A2 are regarded as the emission patterns of the respective antenna elements, the emission pattern of the antenna illustrated in FIG. 1A can be approximated.

More specifically, the magnetic flow sources A1 and A2 are linear magnetic flows placed in parallel to the Y axis. Therefore, no electric wave is emitted in the direction of the Y axis. Also, the electric wave is intensified in a predetermined direction on the Z-X plane. That is, electric waves emitted from the magnetic flow sources A1 and A2 are weakened in the direction of the Y axis irrespectively of the phase difference between the two linear magnetic flows. Furthermore, there is a direction in which the phases of the electric waves emitted from the two magnetic flow sources coincide with each other on the Z-X plane. In that direction, the electric waves are aggregated to be intensified.

FIGS. 4A, 4B, 5A, 5B, 5C, and 6 are illustrations showing examples of the radiation directivity of the antenna illustrated in FIG. 1A. These examples illustrated in FIGS. 4A, 4B, 5A through 5C, and 6 are obtained by assuming that the ground conductor 12 is an infinite plane, and an electric wave is not diffracted at the end of the ground conductor 12. In the following, for the purpose of representing the radiation directivity, a directivity on a horizontal plane (directivity on the X-Y plane) and a directivity on a perpendicular plane (directivity on the Z-X plane) are standardized with their maximum values. In the drawings, a scale of the radiation directivity is in units of 10 dB.

Figure 4A:
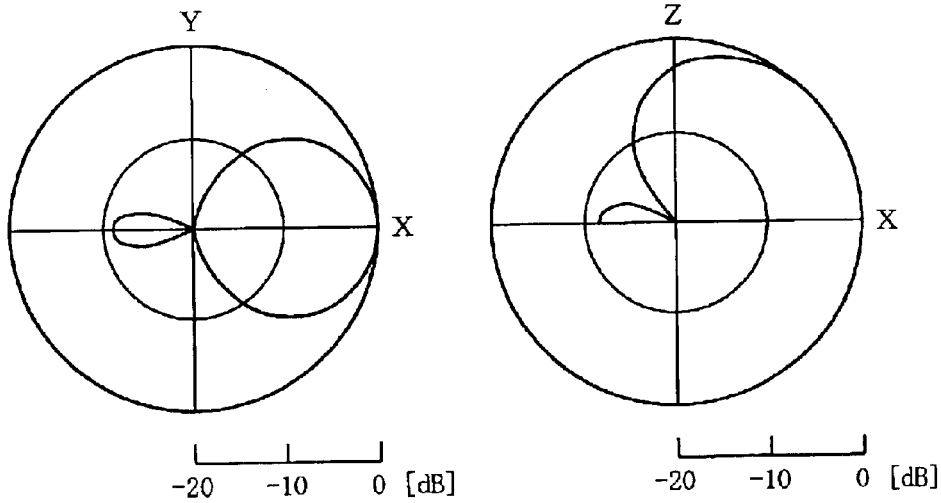
FIGS. 4A and 4B are illustrations showing a first example of the radiation directivity of the antenna according to the first embodiment of the present invention.
Figure 4B:
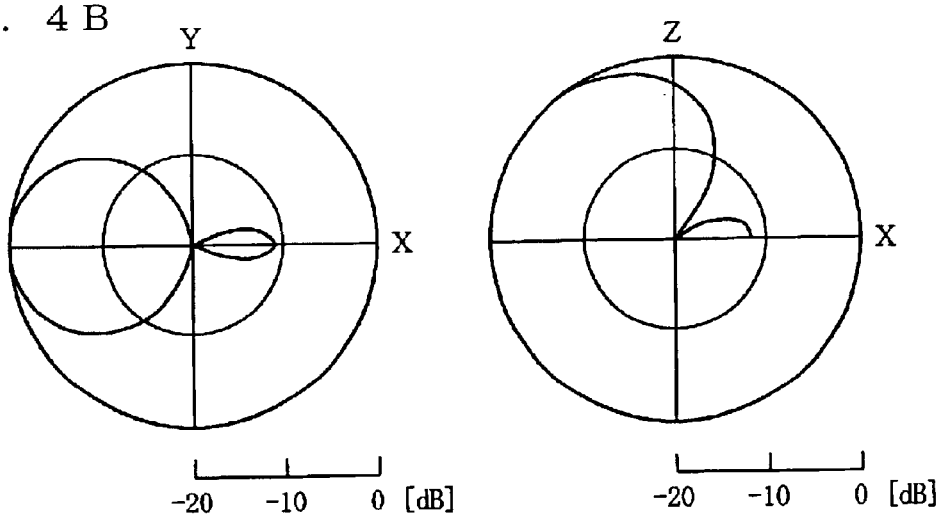

FIGS. 4A and 4B illustrate, as a first example, radiation directivities when the power supply control circuit 20*a* illustrated in FIG. 2A is used. In the first example, it is assumed that the antenna elements 14 and 15 are placed on the X axis symmetrically to each other with respect to the origin, and the distance d1 illustrated in FIG. 3A is a length of 1/24 of the wavelength, and the distance d2 therein is a length of 7/24 of the wavelength, both in free space. Under this assumption, the phase difference between the electric fields is $\pi/2$ [rad.]. FIG. 4A shows the radiation directivity when a signal is supplied only to the antenna element 14, while FIG. 4B shows the radiation directivity when a signal is supplied only to the antenna element 15. As evident from FIGS. 4A and 4B, the electric wave is weakened in the Y direction. Also, as evident from FIG. 4A, when a signal is supplied only to the antenna element 14, the electric wave is intensified in the +X direction. Further, as evident from FIG. 4B, when a signal is supplied only to the antenna element 15, the electric wave is intensified in the −X direction.

As such, with the use of the power supply control circuit 20*a* having the switching function, either one of the antenna elements in operation can be instantaneously selected so that the antenna has an adequate radiation directivity that can even follow a time-varying direction in which an electric wave comes. Therefore, it is possible to achieve an antenna of high reception sensitivity even under a complicated wave propagation environment.

Figure 2C:
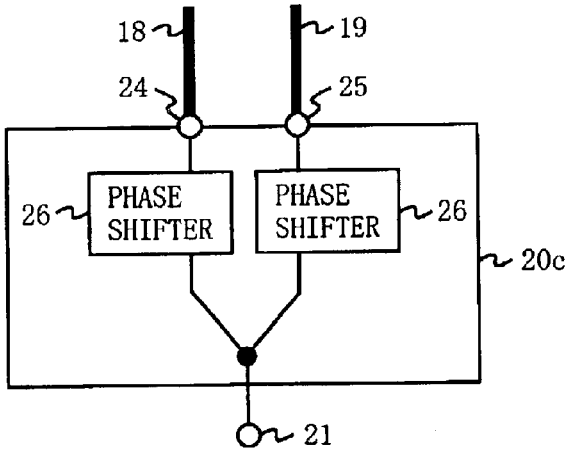
Figure 5A:
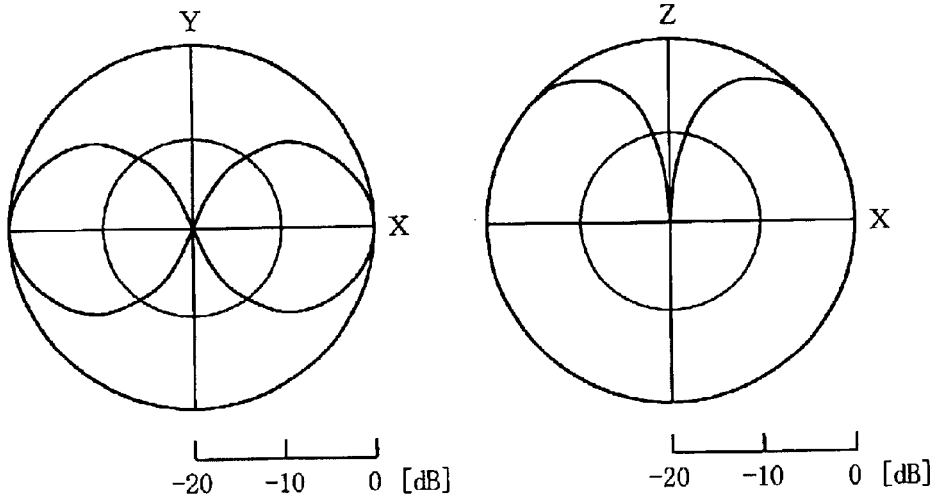
FIGS. 5A through 5C are illustrations showing a second example of the radiation directivity of the antenna according to the first embodiment of the present invention.
Figure 5B:
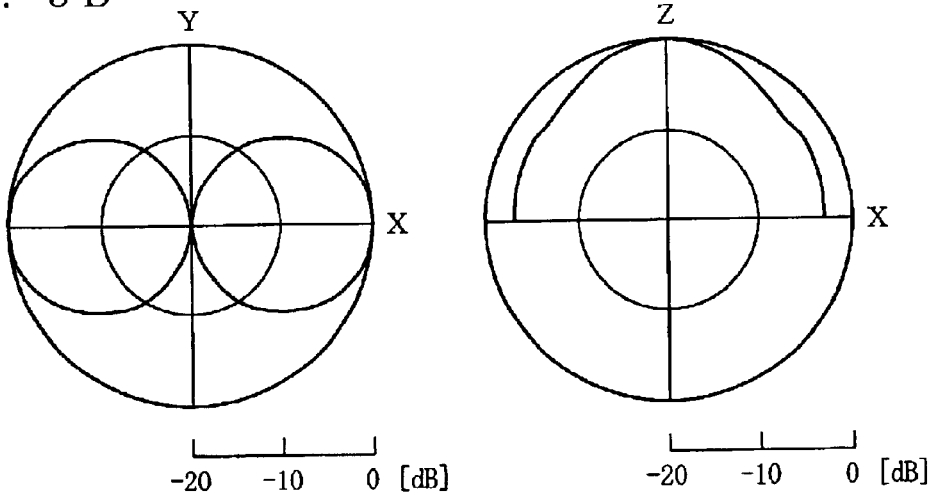
Figure 5C:
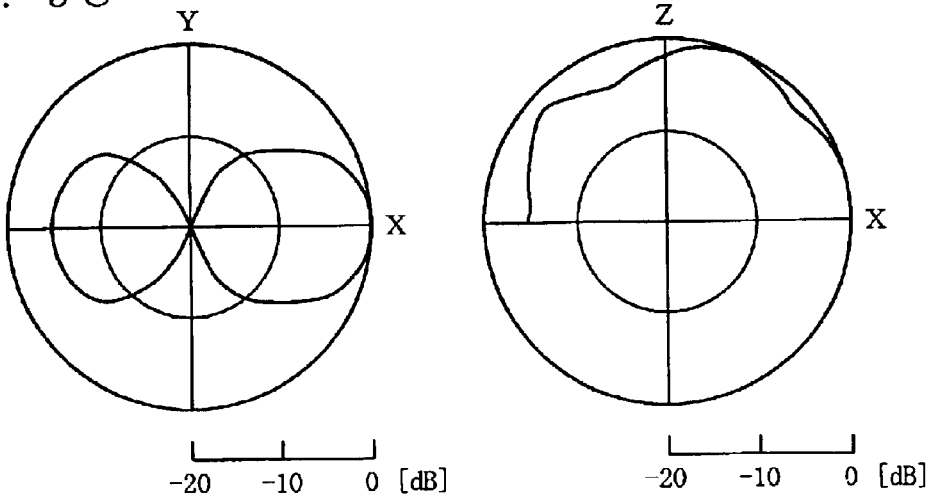

FIGS. 5A through 5C illustrate, as a second example, radiation directivities when the power supply control circuit 20*c* illustrated in FIG. 2C is used. In the second example, it is assumed that the antenna elements 14 and 15 are placed in a the same manner as that of the above first example, and the power supply control circuit 20*c* equally separates the signal supplied through the external connecting terminal 21. FIG. 5A illustrates the radiation directivity when the antenna elements 14 and 15 are supplied with signals equal in amplitude and phase to each other. In this case, two electric fields occurring between the sides S1 and S2 of the top conductor 11 and the ground conductor 12 are oppositely oriented when viewed from the +Z axis direction. Therefore, two magnetic flows are oppositely oriented, and the antenna has a bi-directional directivity in the X axis direction, as illustrated in FIG. 5A. FIG. 5B illustrates the radiation directivity when the antenna elements 14 and 15 are supplied with signals equal in amplitude but opposite in phase to each other. In this case, two electric fields occurring between the sides S1 and S2 of the top conductor 11 and the ground conductor 12 are oriented in the same direction when viewed from the +Z direction. Therefore, two magnetic flows are oriented in the same direction, and the antenna has a directivity intensified in the +Z direction, as illustrated in FIG. 5B. FIG. 5C illustrates the radiation directivity when the antenna elements 14 and 15 are supplied with signals equal in amplitude to each other but different in phase from each other such that the signal supplied to the antenna element 14 is advanced in phase by $\pi/2$ [rad.] from the other signal. In this case, the antenna has a directivity intensified in +X direction, as illustrated in FIG. 5C.

As such, when the power supply control circuit 20*c* having the combining/separating function and the phase shifter 26 is used, it is possible to provide a phase difference to the signals supplied to the antenna elements 14 and 15 by utilizing the phase shifter 26. Thus, the directivity of the antenna can be varied without losing the antenna's features, such as slim and low loss over a high band. For instance, when electric waves come from both of the +X axis direction and the −X axis direction, signals supplied to the antenna elements 14 and 15 are made equal in amplitude and opposite in phase to each other. When electric waves come from only the +X direction, the signals supplied to the antenna elements 14 and 15 are made equal in amplitude to each other and different in phase from each other such that the signal supplied to the antenna element 14 is advanced in phase by $\pi/2$ [rad.] from the other signal.

Figure 2D:
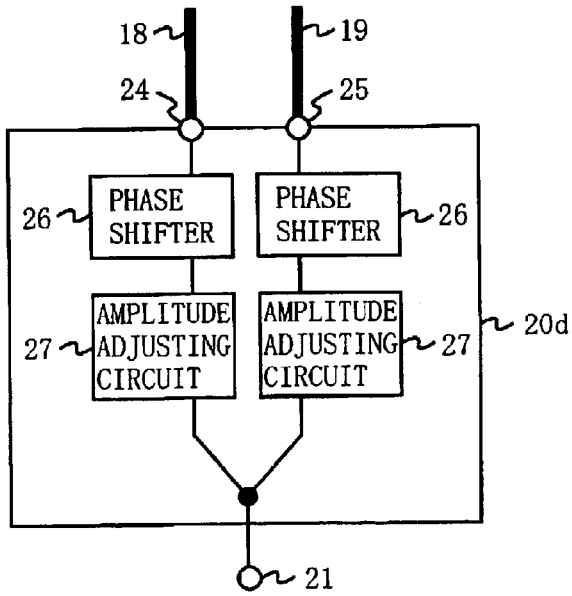
Figure 6:
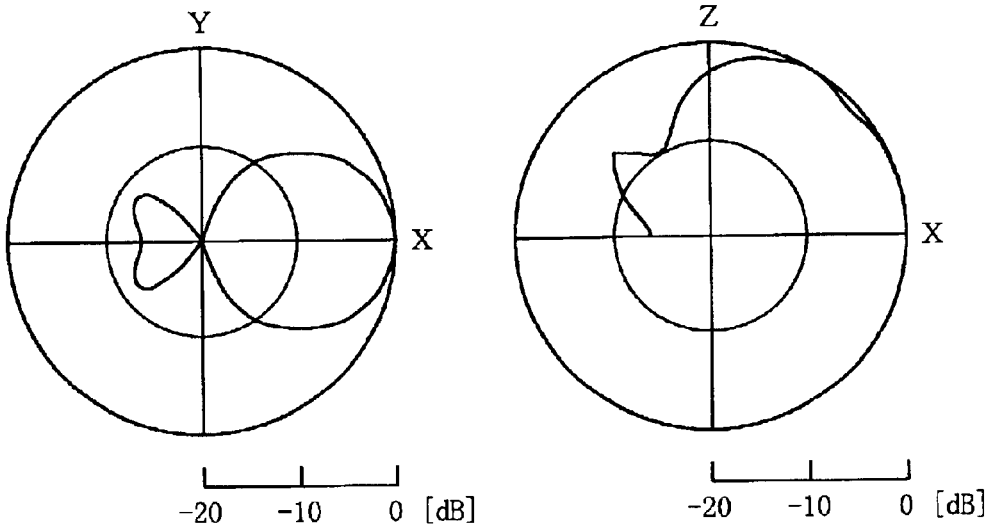
FIG. 6 is an illustration showing a third example of the radiation directivity of the antenna according to the first embodiment of the present invention.

FIG. 6 illustrates, as a third example, the radiation directivity when the power supply control circuit 20*d* illustrated in FIG. 2D is used. In the third example, it is assumed that the antenna elements 14 and 15 are placed in the same manner as that of the above first example, and the power supply control circuit 20*d* separates the signal supplied through the external connecting terminal 21 into two signals at an amplitude ratio of 2:1 for the antenna elements 14 and 15, and supplies the antenna element 14 with one signal whose phase is advanced by $\pi/2$ [rad.] from the phase of the other signal. In the third example, the antenna has a directivity intensified in +X direction, as illustrated in FIG. 6.

As such, when the power supply control circuit 20*d* having the combining/separating function, the phase shifter 26, and the amplitude adjusting circuit 27 is used, it is possible to provide a phase difference and an amplitude difference to the signals supplied to the antenna elements 14 and 15 by utilizing the phase shifter 26 and the amplitude adjusting circuit 27. Thus, the directivity of the antenna can be more flexibly varied. For instance, when an electric wave comes only from the +X direction, the phase shifter 26 and the amplitude adjusting circuit 27 are controlled in the above-described manner.

Figure 7:
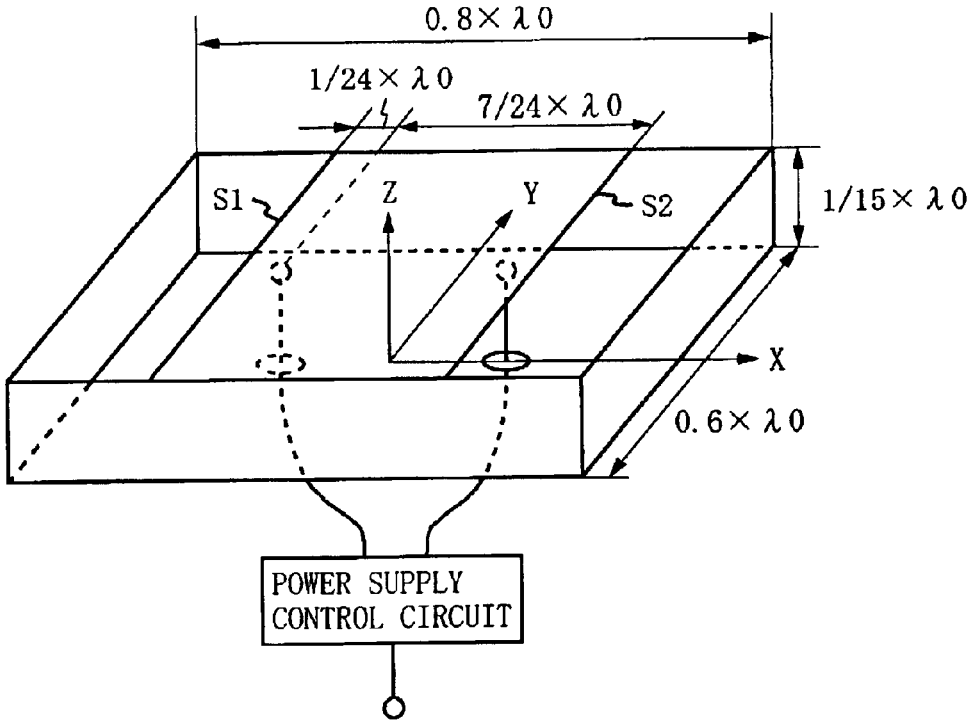
FIG. 7 is an illustration of a first prototype antenna according to the first embodiment of the present invention.

We made a prototype antenna as illustrated in FIG. 7. The characteristics of this prototype antenna are described below. In FIG. 7, when a free space wavelength of $\lambda 0$ is taken as a reference, the ground conductor 12 is shaped like a rectangle whose long side is $0.8\times\lambda 0$ and whose short side is $0.6\times\lambda 0$. The top conductor 11 is shaped like a rectangle whose side parallel to the X axis is $1/3\times\lambda 0$ and whose side parallel to the Y axis is $0.6\times\lambda 0$. The height of each side conductor 13 is $1/15\times\lambda 0$. A distance from the antenna element 14 to the side S1 of the top conductor 11 is $1/24\times\lambda 0$. A distance from the antenna element 14 to the side S2 of the top conductor 11 is $7/24\times\lambda 0$. The antenna box has a symmetric structure with respect to the Z-X plane and the Z-Y plane. The antenna elements 14 and 15 are conductive wires of a diameter of $0.013\times\lambda 0$ and a length of $1/15\times\lambda 0$. Note that the interval between the antenna elements and the width of the top conductor are also based on the assumptions described with reference to FIGS. 4A, 4B, 5A through 5C, and 6.

Figure 8A:
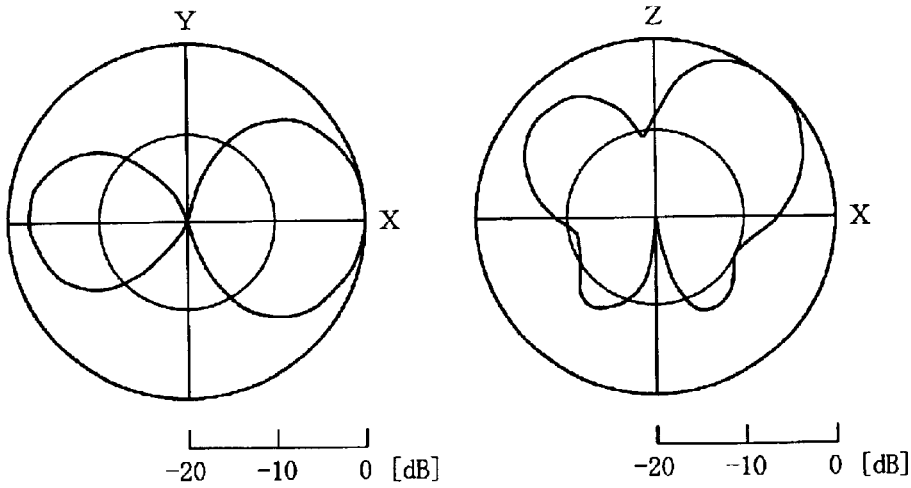
FIGS. 8A and 8B are illustrations showing a first example of the radiation directivity of the first prototype antenna illustrated in FIG. 7.
Figure 8B:
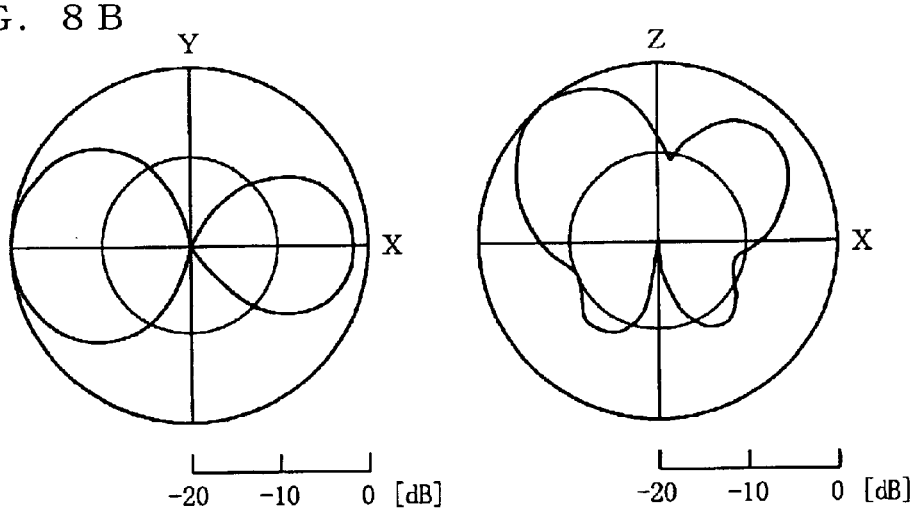

FIGS. 8A, 8B, 9A, 9B, 9C, and 10 illustrate measurement results of the radiation directivities of the prototype antenna illustrated in FIG. 7. FIGS. 8A and 8B illustrate the radiation directivities when the power supply control circuit 20*a* illustrated in FIG. 2A is used. FIG. 8A illustrates the radiation directivity when a signal is supplied only to the antenna element 14. In this case, the phase of the electric field occurring in the vicinity of the opening 22 is advanced by $\pi/2$ [rad.] from that occurring in the vicinity of the opening 23. Therefore, a directivity biased to +X direction was observed in the prototype antenna. FIG. 8B illustrates the radiation directivity when a signal is supplied only to the antenna element 15. In this case, a directivity biased to −X direction was observed in the prototype antenna.

Figure 9A:
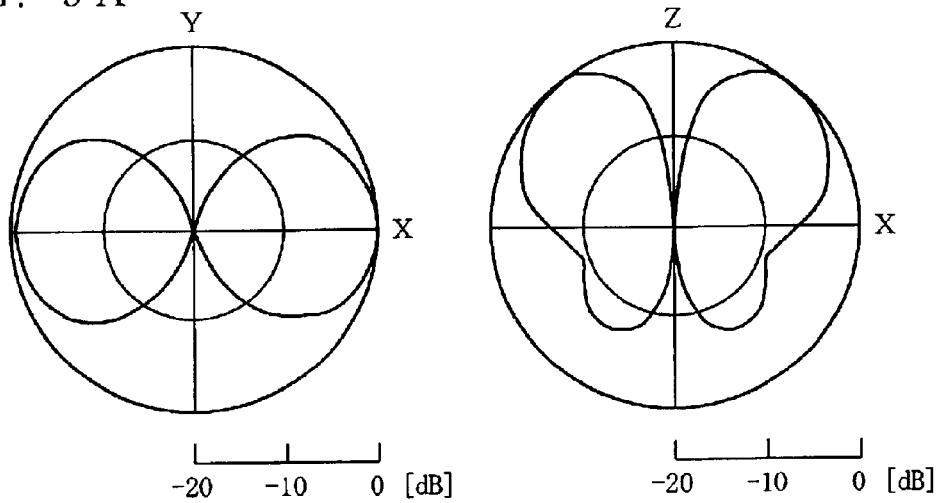
FIGS. 9A through 9C are illustrations showing a second example of the radiation directivity of the first prototype antenna illustrated in FIG. 7.
Figure 9B:
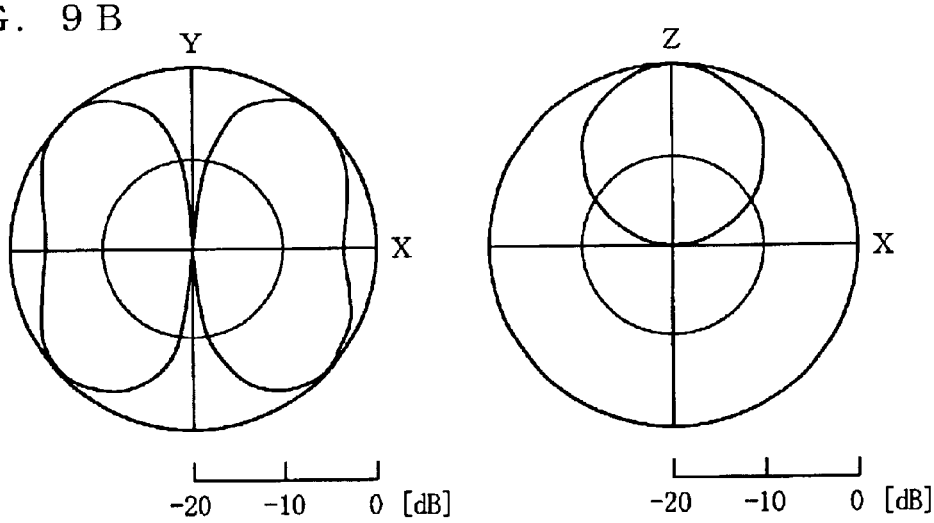
Figure 9C:
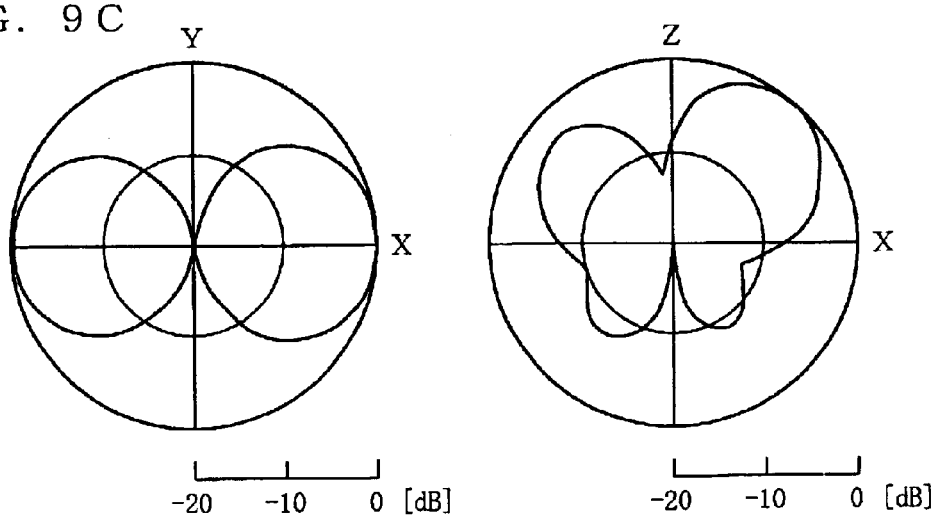

FIGS. 9A through 9C illustrate the radiation directivities when the power supply control circuit 20*c* illustrated in FIG. 2C is used. It is assumed herein that the power supply control circuit 20*c* equally separates the signal supplied through the external connecting terminal 21. FIG. 9A illustrates the radiation directivity when signals equal in amplitude and phase to each other are supplied to the antenna elements 14 and 15. In this case, a bi-directional directivity intensified in the X direction was observed in the prototype antenna. FIG. 9B illustrates the radiation directivity when signals equal in amplitude and but opposite in phase to each other are supplied to the antenna elements 14 and 15. In this case, a bi-directional directivity in the Z direction was observed in the prototype antenna. FIG. 9C illustrates the radiation directivity when the antenna elements 14 and 14 are supplied with signals equal in amplitude to each other but different in phase from each other such that the signal supplied to the antenna element 14 is advanced in phase by $\pi/2$ [rad.] from the other signal. In this case, a directivity biased to the +X direction was observed in the prototype antenna.

Figure 10:
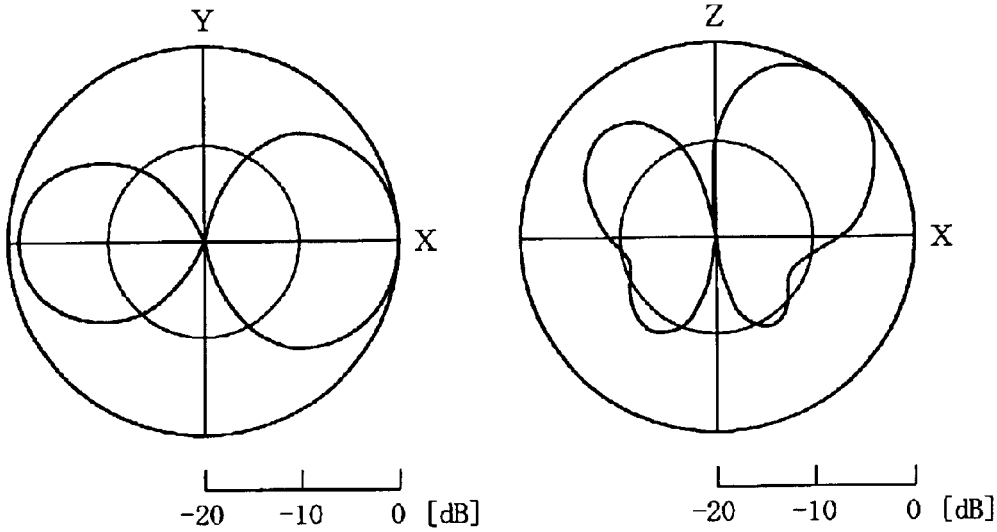
FIG. 10 is an illustration showing a third example of the radiation directivity of the first prototype antenna illustrated in FIG. 7.

FIG. 10 illustrates the radiation directivity when the power supply control circuit 20*d* illustrated in FIG. 2D is used. It is assumed herein that the power supply control circuit 20*d* separates the signal supplied through the external connecting terminal 21 into two signals at an amplitude ratio of 2:1 for the antenna elements 14 and 15, and supplies the antenna element 14 with one signal whose phase is advanced by $\pi/2$ [rad.] from the phase of the other signal. In this case, a directivity biased to the +X direction was observed in the prototype antenna.

In comparison between the measured values illustrated in FIGS. 8A, 8B, 9A through 9C, and 10 and the theoretical values illustrated in FIGS. 4A, 4B, 5A through 5C, and 6, both values have similar characteristics. Note that, in FIGS. 8A, 8B, 9A through 9C, and 10, the prototype antenna emits an electric wave in −Z direction because, in practice, the electric wave is diffracted at the end portion of the ground conductor 12 of a finite size.

Figure 11:
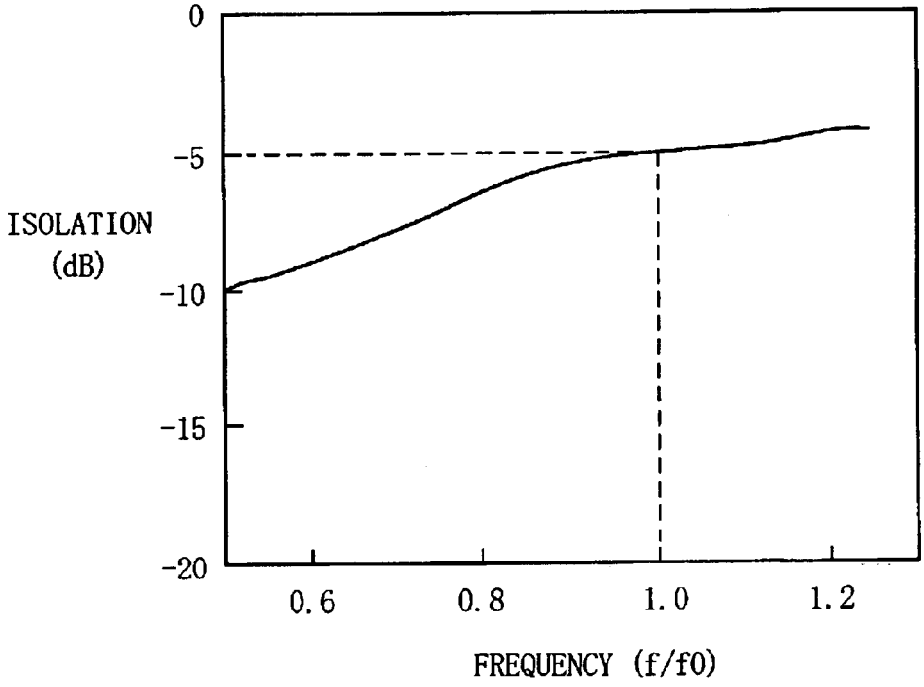
FIG. 11 is a graph showing isolation characteristics of the first prototype antenna illustrated in FIG. 7.

FIG. 11 is a graph showing isolation characteristics (transmission characteristics) in the prototype antenna. The horizontal axis of the graph shown in FIG. 11 represents frequencies standardized with a center frequency of f0 of the prototype antenna. According to FIG. 11, for each of the antenna elements 14 and 15, a value of the isolation characteristics at the center frequency of f0 is −5 dB. Depending on the system that uses the antenna, a more improved value of the above isolation characteristics may be required in some cases.

Figure 12:
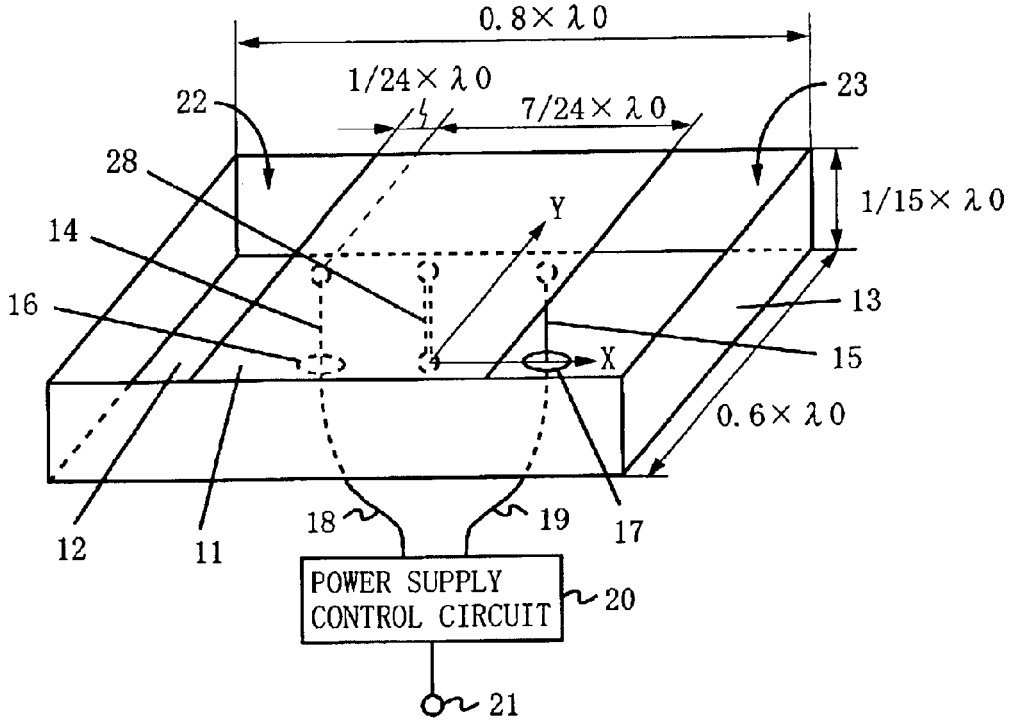
FIG. 12 is an illustration showing the configuration of a second prototype antenna according to the first embodiment of the present invention.

In such cases, as illustrated in FIG. 12, an isolation adjusting conductor 28 is provided to the antenna so as to be connected to the ground conductor 12. In one example illustrated in FIG. 12, the isolation adjusting conductor 28 is connected to the ground conductor 12 at the coordinate origin, and is also connected to the top conductor 11 at the point of intersection of diagonal lines drawn on the top conductor 11. With such isolation adjusting conductor 28 being provided, the isolation characteristics can be improved.

Figure 13:
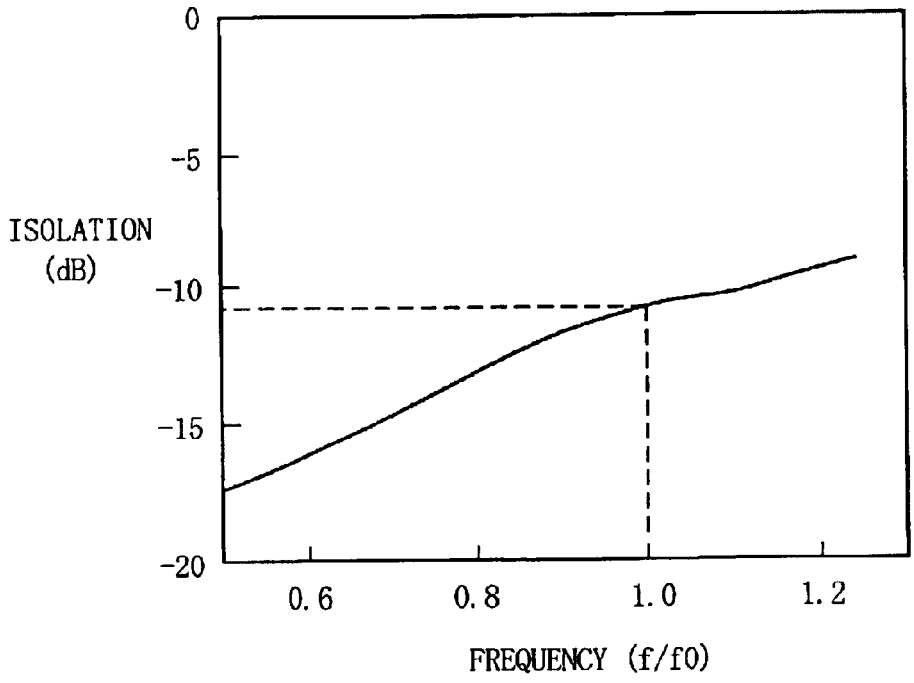
FIG. 13 is a graph showing the isolation characteristics of the second prototype antenna illustrated in FIG. 12.

FIG. 13 is a graph showing isolation characteristics of the prototype antenna illustrated in FIG. 12. The size of this antenna is the same as the size of the prototype antenna illustrated in FIG. 7. According to FIG. 13, with the isolation adjusting conductor 28 being provided, a value of isolation at the center frequency of f0 is −11 dB, thereby obtaining improved isolation characteristics. Note that the isolation adjusting conductor 28 does not change the electric field distribution at the end portion of the top conductor 11 having an influence on radiation. Therefore, the isolation adjusting conductor 28 does not change the radiation characteristics of the antenna.

Therefore, with the isolation adjusting conductor 28 being provided, it is possible to achieve an antenna having desired isolation characteristics and capable of controlling the radiation directivity. Alternatively, in order to obtain desired impedance characteristics or isolation characteristics for the antenna elements, the isolation adjusting conductor 28 may be unconnected to the top conductor 11 depending on the antenna structure.

The height of each of the antenna elements 14 and 15 of the prototype antennas illustrated in FIGS. 7 and 12 is $1/15 \times \lambda 0$, which is lower than that of a normal antenna element of a ¼ wavelength. Such a low height of the antenna element can be achieved because capacitive coupling occurs between the top conductor 11 and cavities of the antenna as if capacitive loads were provided at the top of each of the antenna elements 14 and 15.

Furthermore, the antenna according to the present invention and the prototype antenna have a symmetrical structure with respect to the Z-Y plane and the Z-X plane. With this structure, effects can be achieved such that electric waves emitted from the antenna elements 14 and 15 are symmetrical with respect to the Z-Y plane, and that the radiation directivities between the antenna elements are also symmetrical with respect to the Z-Y plane.

As described above, according to the present embodiment, it is possible to provide a small, slim, simply-structured antenna capable of biasing the directivity to a desired direction and controlling the directivity even after installation.

(Second Embodiment)

Figure 14:
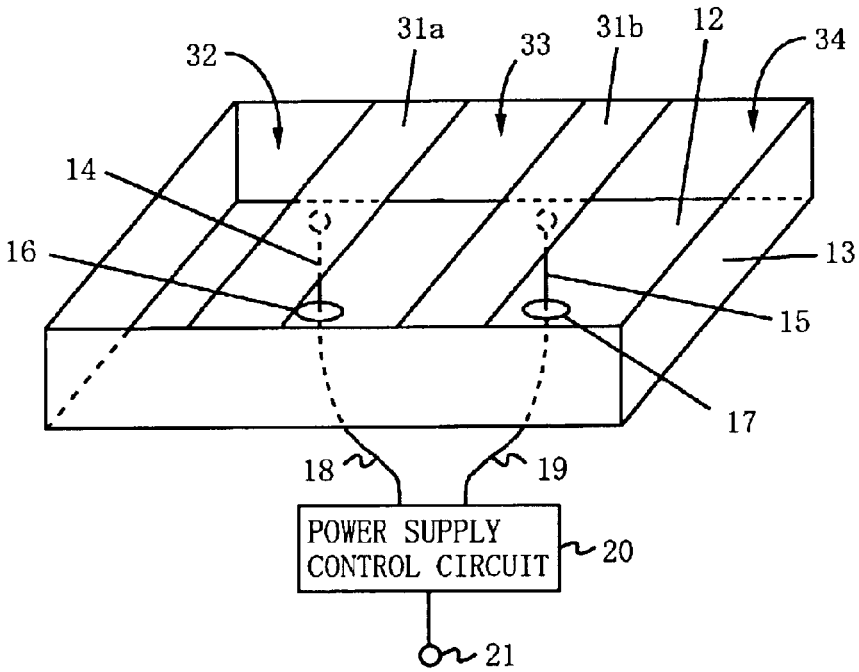
FIG. 14 is an illustration exemplarily showing the configuration of an antenna according to a second embodiment of the present invention.

FIG. 14 is an illustration showing the configuration of an antenna according to a second embodiment of the present invention. This antenna includes, as illustrated in FIG. 14, top conductors 31*a,* and 31*b,* a ground conductor 12, side conductors 13, antenna elements 14 and 15, power supply points 16 and 17 signal lines 18 and 19, a power supply control circuit 20, and an external connecting terminal 21. The top conductors 31*a* and 31*b,* the ground conductor 12, and the side conductors 13 form an antenna box having three openings 32, 33 and 34. This antenna has the following features of: having two antenna elements, two power supply points, and three openings; the box having a symmetric structure with respect to two planes perpendicular to the ground conductor; the top conductors, the ground conductor, and the openings each being shaped like a rectangle; and the antenna elements being connected to the top conductors. If the top conductors 31*a* and 31*b* and the side conductor 13 at the front are removed from the antenna, the antenna is as illustrated in FIG. 1B. As with the first embodiment, the coordinate system shown in FIG. 1B is used in the present embodiment. In the present embodiment, components identical in structure to those in the first embodiment are provided with the same reference numerals, and are not described herein.

The top conductors 31*a,* and 31*b* are rectangular conductive plates of the same size. Two sides of each of the top conductors 31*a* and 31*b* are equal in length to two sides of the ground conductor 12, and the other two sides thereof are shorter in length than the other two sides of the ground conductor 12. The top conductors 31*a,* and 31*b* are placed so as to be opposed to the ground conductor 12 across the antenna elements 14 and 15. In more detail, the top conductors 31*a* and 31*b* are placed so as to satisfy the following conditions: 1) the top conductors 31*a* and 31*b* are placed on the same plane parallel to the ground conductor 12; 2) the top conductors 31*a* and 31*b* are spaced a predetermined distance apart; 3) the two sides equal in length to the two sides of the ground conductor 12 are parallel to the Y axis, and the other two sides are parallel to the X axis; and 4) a point of intersection of diagonal lines drawn on a rectangular area formed between the two top conductors is located on the Z axis. Therefore, the antenna box has three openings 32, 33, and 34 that are symmetrical to both of the Z-Y plane and the Z-X plane.

The present embodiment is similar to the first embodiment in the following three points. First, the side conductors 13 form an antenna box in a shape of a rectangular parallelepiped, together with the top conductors 31*a* and 31*b* and the ground conductor 12. Second, the side conductors 13 are electrically connected to both of the top conductors 31*a* and 31*b* and the ground conductor 12. Third, the power supply control circuit 20 can be implemented by a variety of circuits having different structures.

Also, the operational principle of the antenna illustrated in FIG. 14 is similar to that according to the first embodiment. That is, excitement of an electric wave in the antenna is caused by either one or both of the antenna elements 14 and 15.

By way of example, when a signal is supplied only to the antenna element 14, an electric field occurs between both ends of the top conductor 31*a* and the ground conductor 12. Based on the same operational principle as that of the conventional antenna, an electric wave is emitted. Here, the top conductor 31*b* acts as an electric wave reflector. Therefore, the antenna has a directivity biased to −X axis direction. When a signal is supplied only to the antenna element 15, on the other hand, the top conductor 31*a* acts as an electric wave reflector. Therefore, the antenna has a directivity biased to +X axis direction. As such, with the use of the power supply control circuit 20*a* having the switching function, either one of the antenna elements in operation can be instantaneously selected so that the antenna has an adequate radiation directivity that can even follow a time-varying direction in which an electric wave comes. Therefore, it is possible to achieve an antenna of high reception sensitivity even under a complicated wave propagation environment.

Furthermore, when the power supply control circuit 20*c* having the combining/separating function and the phase shifter 26 is used, it is possible to provide a phase difference to the signals supplied to the antenna elements 14 and 15 by utilizing the phase shifter 26. Thus, the directivity of the antenna can be varied. Still further, when the power supply control circuit 20*d* having the combining/separating function, the phase shifter 26, and the amplitude adjusting circuit 27 is used, it is possible to provide a phase difference and an amplitude difference to the signals supplied to the antenna elements 14 and 15 by utilizing the phase shifter 26 and the amplitude adjusting circuit 27. Thus, the directivity of the antenna can be more flexibly varied. These points are the same as those described in the first embodiment.

Figure 15:
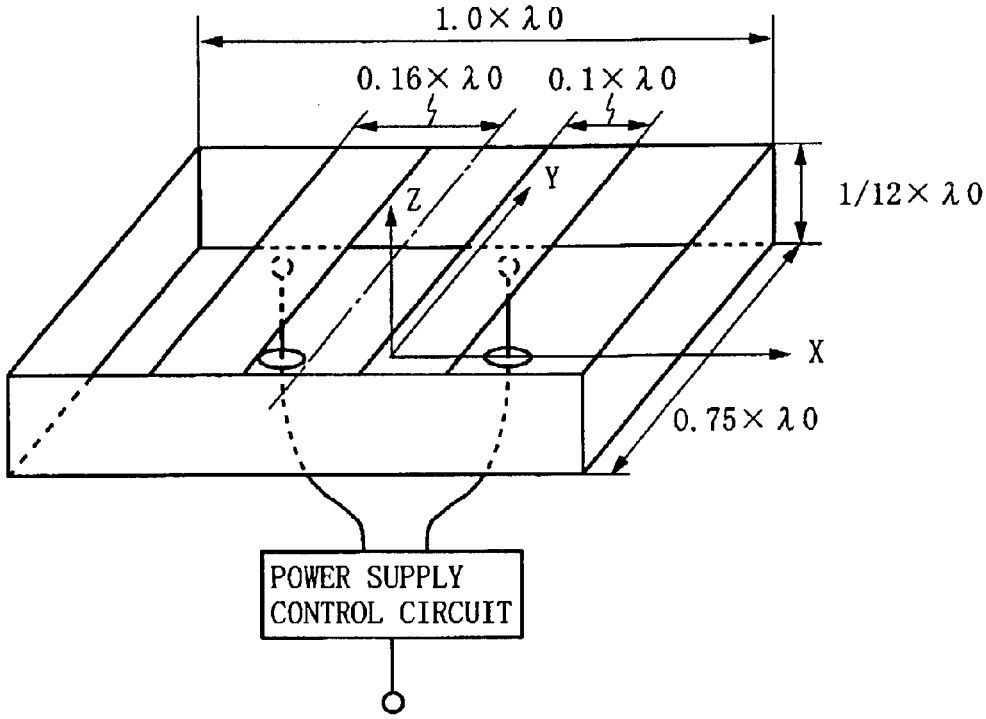
FIG. 15 is an illustration showing a prototype antenna according to the second embodiment of the present invention.

We made a prototype antenna as illustrated in FIG. 15. The characteristics of this prototype antenna are described below. In FIG. 15, when a free space wavelength of $\lambda 0$ is taken as a reference, the ground conductor 12 is shaped like a rectangle whose long side is $1.0\times\lambda 0$ and whose short side is $0.75\times\lambda 0$. Each of the top conductor 31*a* and 31*b* is shaped like a rectangle whose side parallel to the X axis is $0.1\times\lambda 0$ and whose side parallel to the Y axis is $0.75\times\lambda 0$. The height of each side conductor 13 is $1/12\times\lambda 0$. The power supply points 16 and 17 are located on the X axis and are spaced a distance of $0.16\times\lambda$ apart from the origin. The antenna element 14 is electrically connected to the top conductor 31*a* at a point of intersection of diagonal lines drawn on the top conductor 31*a*. The antenna element 15 is electrically connected to the top conductor 31*b* at a point of intersection of diagonal lines drawn on the top conductor 31*b*. The antenna box has a symmetric structure with respect to the Z-X plane and the Z-Y plane. The antenna elements 14 and 15 are conductive wires of a diameter of $0.013\times\lambda 0$ and a length of $1/12\times\lambda 0$.

Figure 16A:
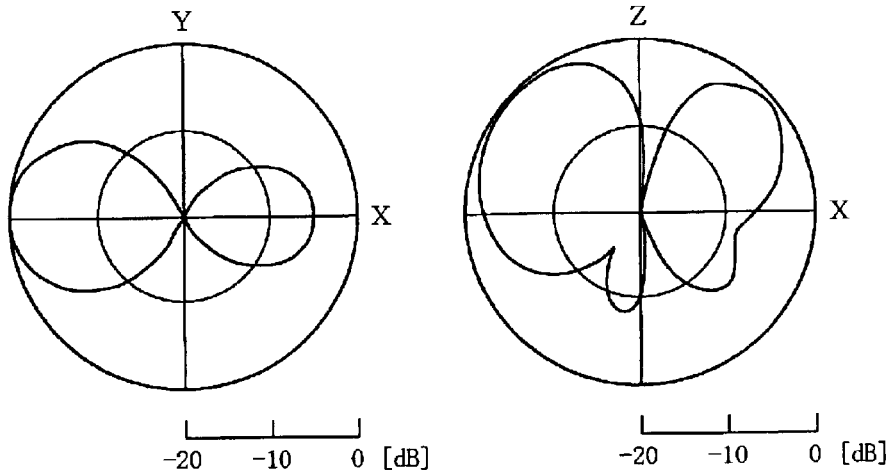
FIGS. 16A and 16B are illustrations showing a first example of the radiation directivity of the prototype antenna illustrated in FIG. 15.
Figure 16B:
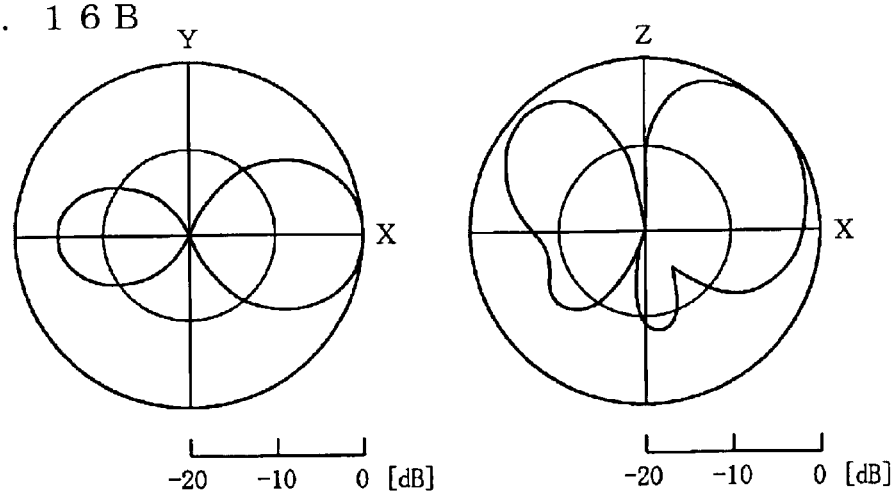

FIGS. 16A, 16B, 17A through 17C, and 18 illustrate measurement results of the radiation directivities of the prototype antenna illustrated in FIG. 15. FIGS. 16A and 16B illustrate the radiation directivities when the power supply control circuit 20*a* illustrated in FIG. 2A is used. FIG. 16A illustrates the radiation directivity when a signal is supplied only to the antenna element 14. In this case, the top conductor 31*b* acts as a reflector. Therefore, a directivity biased to +X direction was observed in the prototype antenna. FIG. 16B illustrates the radiation directivity when a signal is supplied only to the antenna element 15. In this case, the top conductor 31*a* acts as a reflector. Therefore, a directivity biased to −X direction was observed in the prototype antenna.

Figure 17A:
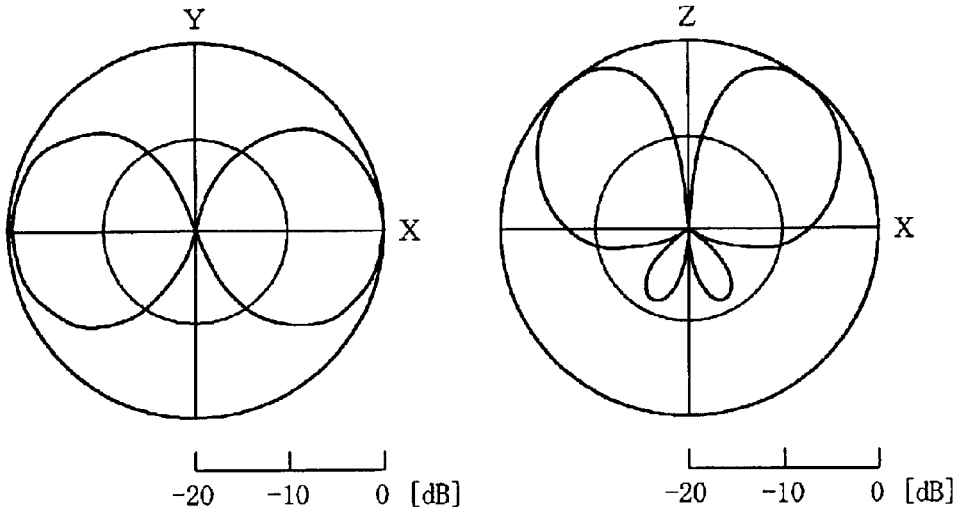
FIGS. 17A through 17C are illustrations showing a second example of the radiation directivity of the prototype antenna illustrated in FIG. 15.
Figure 17B:
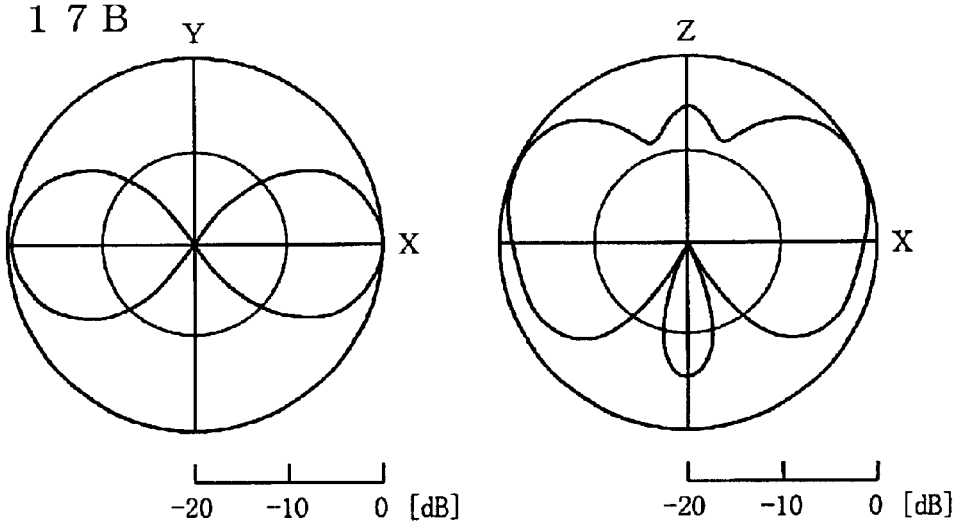
Figure 17C:
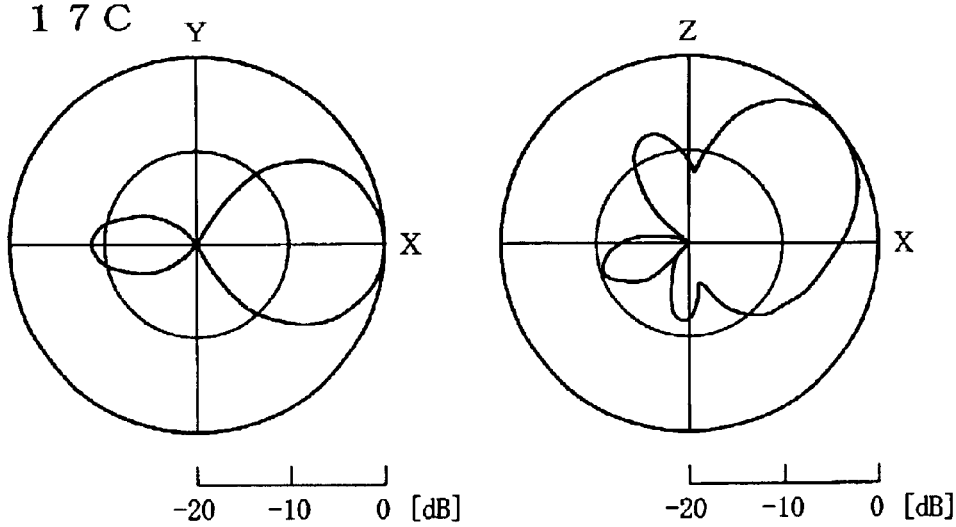

FIGS. 17A through 17C illustrate the radiation directivities when the power supply control circuit 20*c* illustrated in FIG. 2C is used. It is assumed herein that the power supply control circuit 20*c* equally separates the signal supplied through the external connecting terminal 21. FIG. 17A illustrates the radiation directivity when signals equal in amplitude and phase to each other are supplied to the antenna elements 14 and 15. In this case, a bi-directional directivity in the X direction was observed in the prototype antenna. FIG. 17B illustrates the radiation directivity when signals equal in amplitude and but opposite in phase to each other are supplied to the antenna elements 14 and 15. In this case, a directivity in the +Z direction was observed in the prototype antenna. FIG. 17C illustrates the radiation directivity when the antenna elements 14 and 15 are supplied with signals equal in amplitude to each other but different in phase from each other such that the signal supplied to the antenna element 14 is advanced in phase by $\pi/2$ [rad.] from the other signal. In this case, a directivity biased to the +X direction was observed in the prototype antenna.

Figure 18:
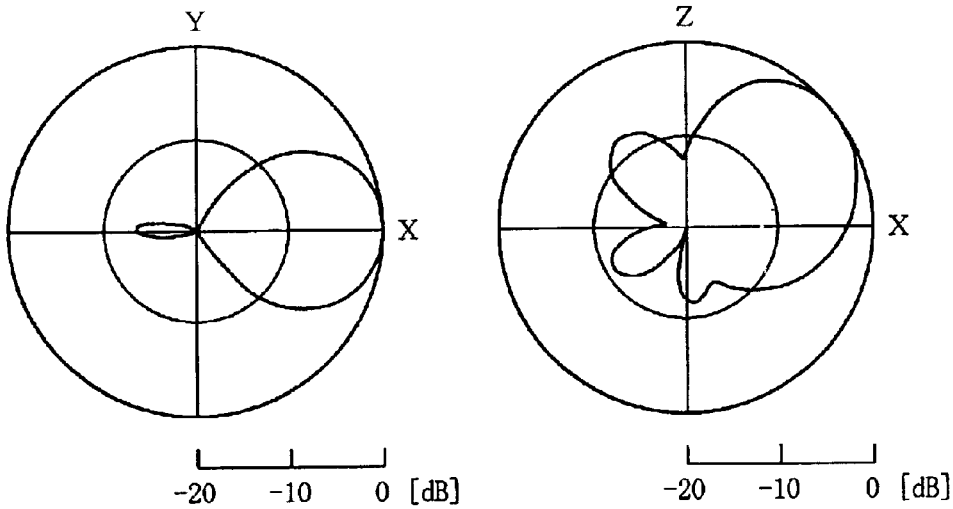
FIG. 18 is an illustration showing a third example of the radiation directivity of the prototype antenna illustrated in FIG. 15.

FIG. 18 illustrates the radiation directivity when the power supply control circuit 20*d* illustrated in FIG. 2D is used. It is assumed herein that the power supply control circuit 20*d* separates the signal supplied through the external connecting terminal 21 into two signals at an amplitude ratio of 2:1 for the antenna elements 14 and 15, and supplies the antenna element 14 with one signal whose phase is advanced by $\pi/2$ [rad.] from the phase of the other signal. In this case, a directivity biased to the +X direction was observed in the prototype antenna.

The height of each of the antenna elements 14 and 15 of the prototype antenna illustrated in FIG. 15 is $1/12\times\lambda 0$, which is lower than that of a normal antenna element of a ¼ wavelength. The reasons why such a low height of the antenna element can be achieved are as described in the first embodiment.

Furthermore, the antenna according to the present invention and the prototype antenna have a symmetrical structure with respect to the Z-Y plane and the Z-X plane. With this structure, effects can be achieved such that electric waves emitted from the antenna elements 14 and 15 are symmetrical with respect to the Z-Y plane, and that the radiation directivities between the antenna elements are also symmetrical with respect to the Z-Y plane.

As described above, according to the present embodiment, it is possible to provide a small, slim, simply-structured antenna capable of biasing the directivity to a desired direction and controlling the directivity even after installation.

(Third Embodiment)

Figure 19A:
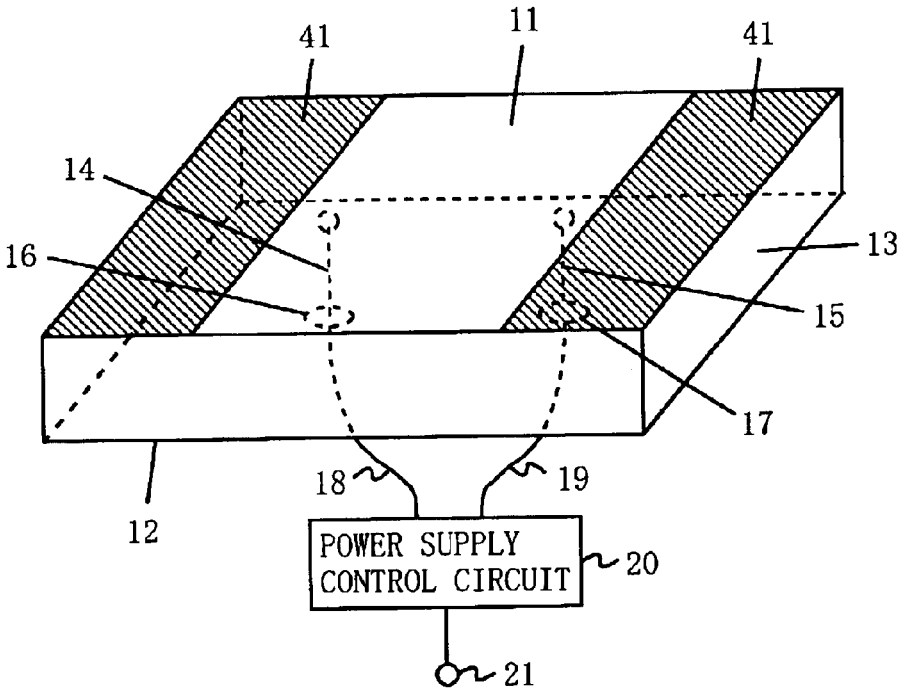
FIGS. 19A and 19B are illustrations showing examples of the configuration of antennas according to a third embodiment.
Figure 19B:
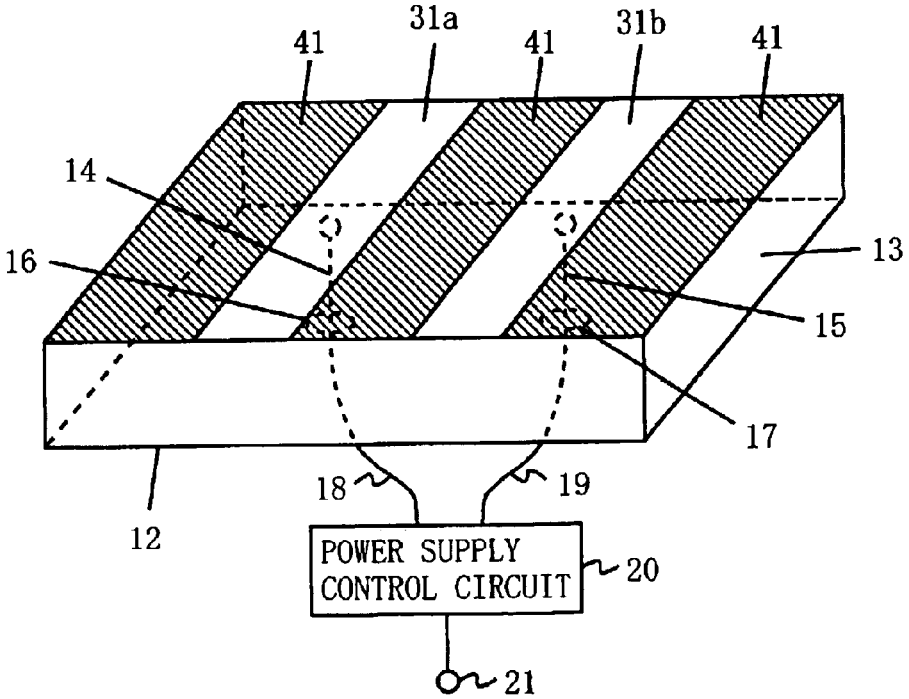

FIGS. 19A and 19B are illustrations showing the configuration of antennas according to the third embodiment of the present invention. An antenna illustrated in FIG. 19A is similar to the antenna according to the first embodiment with a dielectric material 41 placed inside of the antenna box. An antenna illustrated in FIG. 19B is similar to the antenna according to the second embodiment with the dielectric material 41 placed inside of the antenna box. The dielectric material 41 is fully filled inside of the antenna box. The antenna illustrated in FIG. 19A is similar to that according to the first embodiment except that the dielectric material 41 is provided. Also, the antenna illustrated in FIG. 19B is similar to that according to the second embodiment except that the dielectric material 41 is provided.

The antenna illustrated in FIG. 19A operates in a manner similar to that of the antenna according to the first embodiment. The antenna illustrated in FIG. 19B operates in a manner similar to that of the antenna according to the second embodiment. The two antennas illustrated in FIGS. 19A and 19B, however, are each provided with the dielectric material 41 inside of the antenna box. Therefore, when a relative dielectric constant of the dielectric material 41 (a ratio of a dielectric constant of the dielectric material with respect to a dielectric constant of vacuum $\in_0$)) is $\in_r$, the wavelength inside of the dielectric material 41 is $(\in_r)^{-1/2}$ times larger than the wavelength in a vacuum. Since the relative dielectric constant $\in_r$ of the dielectric material 41 is 1 or larger, the wavelength is reduced inside of the dielectric material 41. Therefore, with the dielectric material 41 being provided inside of the antenna box, the antenna can be made smaller and slimmer.

Figure 20:
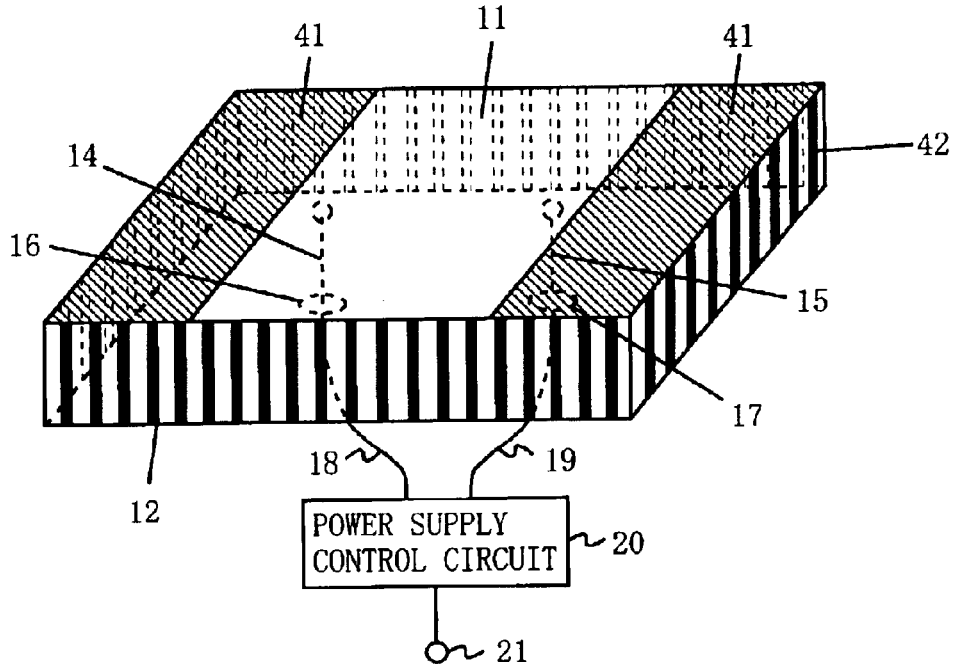
FIG. 20 is an illustration showing an example in which the antenna according to the third embodiment of the present invention is manufactured with a board processing technique.

Also, the antennas according to the present embodiment have a feature that these antennas can be manufactured with a dielectric plate having both surfaces laminated with a conductive foil. FIG. 20 is an illustration showing the configuration of an antenna manufactured by using such a dielectric plate. In FIG. 20, the dielectric material 41 is implemented by the above-described dielectric plate. The side conductors 13 are formed by covering the side planes of the dielectric with via holes.

The antenna illustrated in FIG. 20 is manufactured in the following scheme, for example. First, a dielectric plate having both surfaces laminated with conductive foils is prepared then, part of the conductive foil on one surface of the dielectric plate is sliced away by etching or machine processing. The sliced portion will become an opening, and the remaining portions will become a top conductor 11. Also, the conductive foil on the other surface of the dielectric plate will become a ground conductor 12. Then, the dielectric plate is provided with a large number of via holes so as to form the outer line of the ground conductor 12. Then, in order to form power supply points 16 and 17 the ground conductor 12 is provided with holes of predetermined diameter and depth. Then, at these holes, thin holes are further provided so as to penetrate through the dielectric material 41. Through these thin holes, internal conductors of conductive wires are drawn, and their tips are electrically connected to the top conductor 11 by soldering or the like. Finally, the dielectric plate is cut along a line of the via holes. With the surfaces of the dielectric plate being provided with the via holes, the side conductors 13 are formed on the surfaces of the dielectric plate.

As such, by manufacturing an antenna with the use of a plate processing technology such as etching, the accuracy in manufacturing the antenna can be improved. Also, cost incurred in mass production of antennas can be reduced.

Alternatively, the antenna illustrated in FIG. 20 can be manufactured by using a dielectric plate having only one surface laminated with a conductive foil. In this case, for example, two such dielectric plates each having only one surface laminated with a conductive foil are prepared. Then, part of the conductive foil of one plate is removed by etching or machine processing. Then, these two dielectric plates are stuck together on surfaces not laminated with a conductive foil.

In an antenna having an opening, air full of dust or moisture tends to enter the inside of the antenna box from the opening, depending on the environment where the antenna is installed. This deteriorates the characteristics of the antenna. According to the antenna of the present embodiment, however, the inside of the antenna box is filled with the dielectric material, thereby preventing the antenna characteristics from being deteriorated due to air full of dust or moisture.

In the antennas illustrated in FIGS. 19A, 19B, and 20, the inside of the antenna box is entirely filled with the dielectric material. Alternatively, only part of the inside thereof can be filled with the dielectric material. For example, the above-described effects can be achieved by laminating a dielectric plate so as to cover each opening.

As described above, according to the present embodiment, it is possible to provide a small, slim, simply-structured antenna capable of biasing the directivity to a desired direction and preventing air full of dust or moisture from entering the inside of the antenna box.

(Modifications of First through Third Embodiments)

Modifications of antennas according to the first through third embodiments are exemplarily described below. The effects of the antennas described below are similar to those achieved by the antennas according to the first through third embodiments.

First, in the first through third embodiments, the antenna box has a symmetrical structure with respect to the Z-Y plane and the Z-X plane. This is not meant to be restrictive. For example, for the purpose of obtaining a desired radiation directivity or desired input impedance characteristics, the antenna box can have a symmetrical structure with respect only to the Z-Y plane, or can have an asymmetrical structure with respect to both of the Z-Y plane and the Z-X plane. Furthermore, only the openings can be provided in the above same manner. Still further, only the antenna elements can be placed symmetrically with respect only to the Z-Y plane, or can be placed symmetrically with respect to both of the Z-Y plane and the Z-X plane. Still further, only the top conductor can be formed symmetrically with respect only to the Z-Y plane, or can be placed symmetrically with respect to both of the Z-Y plane and the Z-X plane. Still further, only the side conductors can be formed symmetrically with respect only to the Z-Y plane, or can be placed symmetrically with respect to both of the Z-Y plane and the Z-X plane. Still further, the above-described symmetrical or asymmetrical features can be arbitrarily combined to form an antenna. Of the possible configurations the antenna can take, the most suitable one is selected. With this, it is possible to provide an antenna having a directivity optimal to a space to which an electric wave is emitted.

In the first embodiment, the antenna has two openings. In the second embodiment, the antenna has three openings. In the third embodiment, the antenna has two or three openings. None of these are meant to be restrictive. For example, for the purpose of obtaining a desired radiation directivity or desired input impedance characteristics, the antenna can have four or more openings.

Also, in the first through third embodiments, each opening of the antenna is shaped like a rectangle. This is not meant to be restrictive. For example, for the purpose of obtaining a desired radiation directivity or desired input impedance characteristics, the opening can be shaped like a circle, square, polygon, semicircle, or a combination of the above, a loop, or other arbitrary figure. Particularly, when the opening is shaped like a curved figure, such as a circle or ellipse, the number of corner portions in the antenna conductive portion are reduced. Therefore, diffraction of an electric wave at the corner portions can be reduced. This is quite effective in view of the radiation directivity because a cross polarization conversion loss of the electric wave emitted from the antenna is reduced.

Furthermore, in the first through third embodiments, the openings and the top conductor(s) are located on the same plane. This is not meant to be restrictive. For example, for the purpose of obtaining a desired radiation directivity or desired input impedance characteristics, the openings can be formed on a plane on which one of the side conductors is placed.

Still further, an antenna having an isolation adjusting conductor is described only in the first embodiment. The antennas according to the second and third embodiments can have such an isolation adjusting conductor. Therefore, as with the first embodiment, isolation between the antenna elements can be improved.

Still further, in the first through third embodiments, the ground conductor is shaped like a rectangle. This is not meant to be restrictive. For example, for the purpose of obtaining a desired radiation directivity or desired input impedance characteristics, the ground conductor can be shaped like a polygon other than a rectangle, semicircle, circle, ellipse, or a combination of the above, or other arbitrary figure. Particularly, when the ground conductor is shaped like a curved figure, such an effect can be obtained, as with a case of the opening, that a cross polarization conversion loss of the electric wave emitted from the antenna is reduced.

Figure 21:
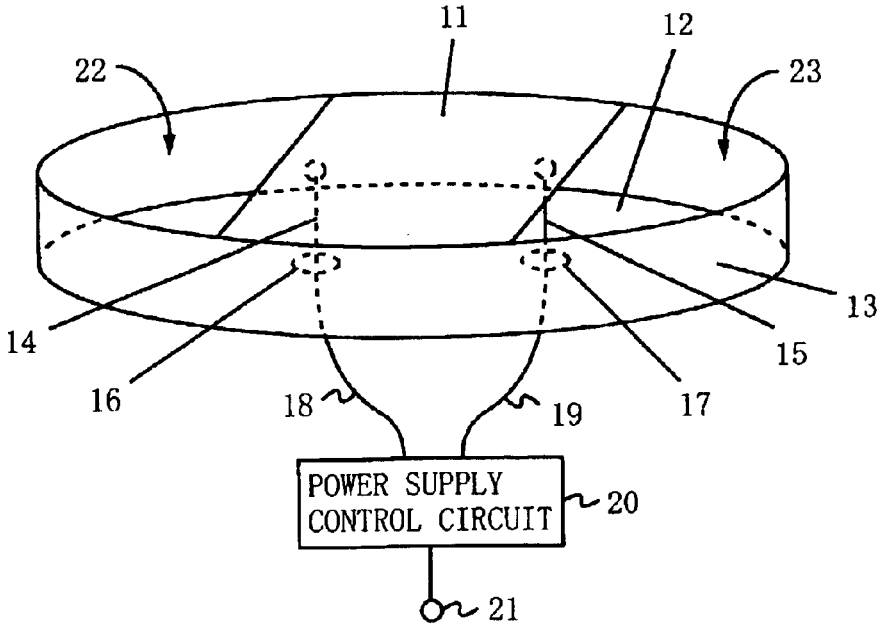
FIG. 21 is an illustration showing the configuration of an antenna according to an exemplary modification of the first embodiment of the present invention.

Still further, in consideration of the state of grounding the antenna, as illustrated in FIG. 21, one preferable antenna includes the ground conductor being shaped like a circle and the antenna box being shaped like a cylinder. The reasons are as follows. When the antenna is installed on a ceiling, for example, the shape of the antenna preferably conforms to squares often designed on the ceiling or the shape of a room in order to prevent the antenna from being conspicuous. When the antenna is shaped like a polygon, such as a rectangle, an installing direction allowing the antenna to be inconspicuous is disadvantageously limited due to the fixed squares on the ceiling or the fixed shape of the room. In order to get around this disadvantage, the ground conductor being shaped like a circle and the antenna box being shaped like a cylinder are used. With this, the antenna can be installed in an arbitrary direction without taking the squares on the ceiling or the shape of the room into consideration.

Still further, in the first through third embodiments, the top conductor is shaped like a rectangle. This is not meant to be restrictive. For example, for the purpose of obtaining a desired radiation directivity or desired input impedance characteristics, the top conductor can be shaped like a polygon other than a rectangle, semicircle, circle, ellipse, or a combination of the above, or other arbitrary figure. Particularly, when the top conductor is shaped like a curved figure, such an effect can be obtained, as with a case of the opening and the ground conductor, that a cross polarization conversion loss of the electric wave emitted from the antenna is reduced.

Figure 22A:
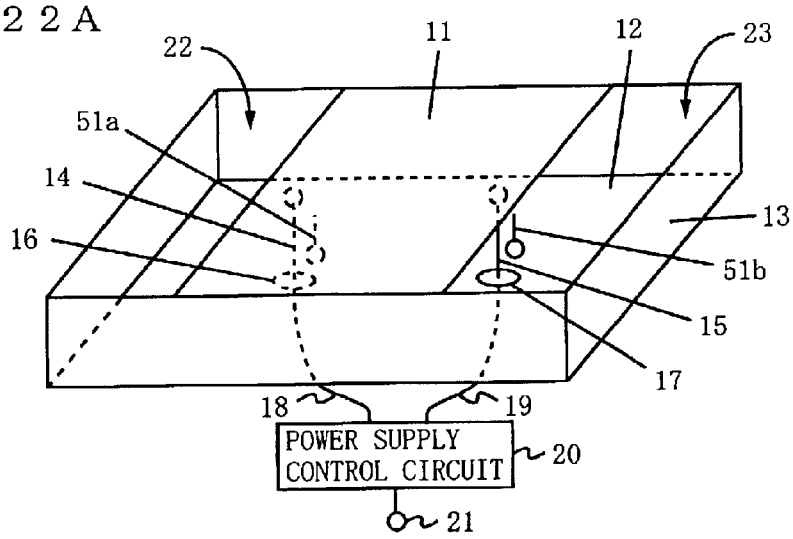
FIGS. 22A through 22C are illustrations showing the configurations of antennas according to other exemplary modifications of the first embodiment of the present invention.
Figure 22B:
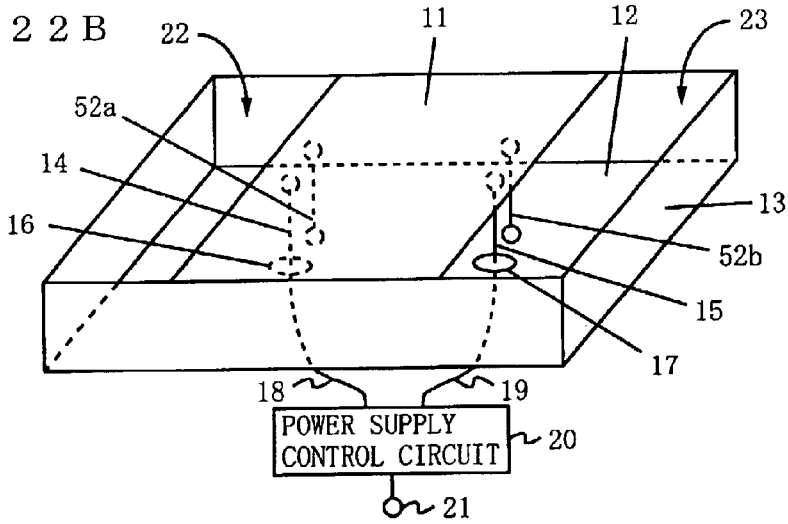
Figure 22C:
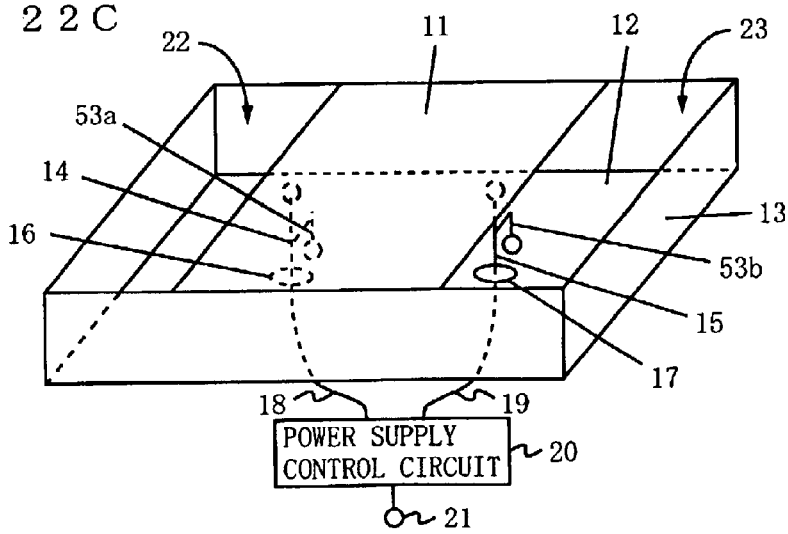

Still further, in the first through third embodiments, matching conductors can be provided. Three types of antenna illustrated in FIGS. 22A through 22C are obtained by adding matching conductors to the antenna according to the first embodiment. In the antenna illustrated in FIG. 22A, matching conductors 51*a* and 51*b* are both connected to the ground conductor 12. In the antenna illustrated in FIG. 22B, matching conductors 52*a* and 52*b* are both connected to both of the top conductor 11 and the ground conductor 12. With such matching conductors being provided, it is possible to match an impedance of each antenna element and an impedance of each power supply line, thereby efficiently supplying power. Alternatively, as illustrated in FIG. 22C, matching conductors 53*a* and 53*b* can be both connected to the ground conductor 12 and the antenna elements 14 and 15, respectively. Still alternatively, matching conductors can be provided to the antenna according to the second or third embodiment.

Figure 23:
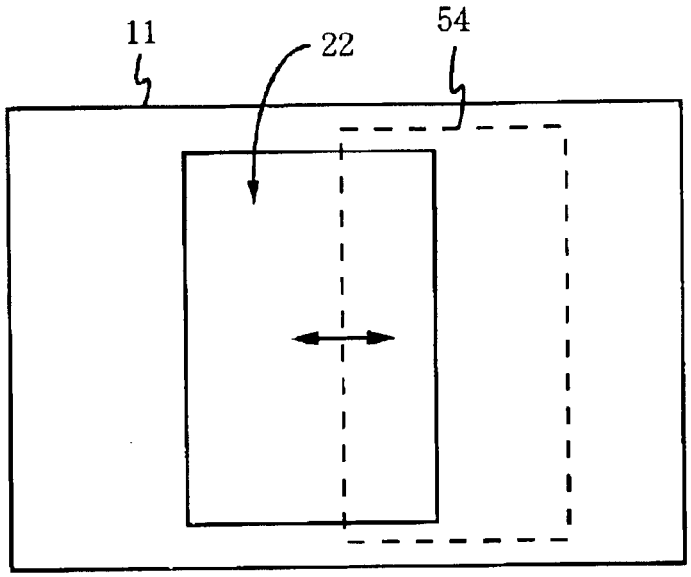
FIG. 23 is an illustration showing the configuration of a opening controller of the antenna according to one of the embodiments of the present invention.

Still further, in the first through third embodiments, the size of each opening is fixed. This is not meant to be restrictive. For example, as illustrated in FIG. 23, an opening control section 54 can be provided adjacently to the opening 22 to change the size of the opening 22. The opening control section 54 slides a conductor plate to arbitrarily change the size of the opening 22. With this, the radiation directivity of the antenna can be changed. Also, a control of the radiation directivity by the opening control section 53 can be combined with a control thereof by the power supply control circuit 20, thereby easily achieving a desired radiation directivity.

Still further, in the first through third embodiments, each antenna element is implemented by a linear conductor. Alternatively, the antenna element can be implemented, for example, by a helical antenna element composed of a spiral conductive wire. With this, the antenna element can be reduced in size and height, thereby reducing the antenna in size and height.

Figure 24:
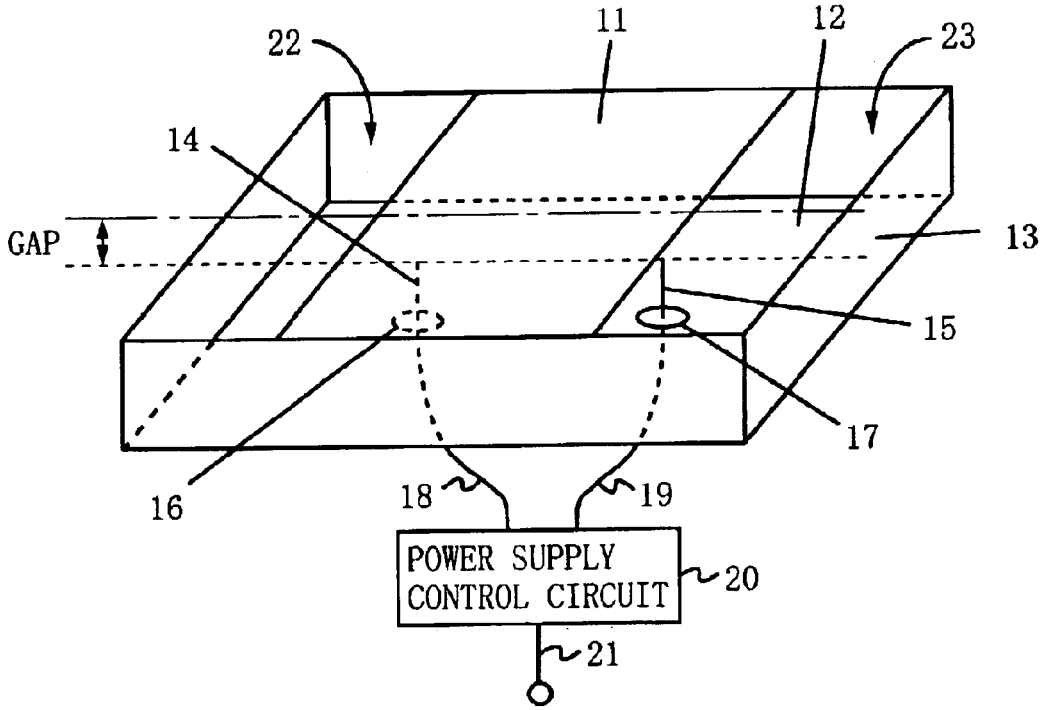
FIG. 24 is an illustration showing the configuration of an antenna according to still another exemplary modification of the first embodiment of the present invention.

Still further, as illustrated in FIG. 24, a predetermined amount of gap can be provided between the antenna elements 14 and 15 and the top conductor 11 to electrically open these antenna elements 14 and 15. With this, the impedance can be changed, thereby adjusting a resonance frequency.

Still further, the antennas according to the first through third embodiments can be placed in an array to form a phased array antenna or an adaptive antenna array. With this, the directivity of the emitted electric wave can be more accurately controlled.

(Fourth Embodiment)

FIGS. 25A, 25B, 26A, 26B, 27A, 27B, 28A, and 28B are illustrations showing examples of the configuration of antennas according to a fourth embodiment of the present invention. Antennas illustrated in FIGS. 25A, 25B, 26A, and 26B each have a feature that a power supply control circuit is placed on a ground conductor inside of an antenna box. Antennas illustrated in FIGS. 27A, 27B, 28A, and 28B each have a feature that a power supply control circuit is placed in a concave portion on a ground conductor outside of an antenna box. Details of these antennas are described below with reference to these drawings. Note that these antennas operate in a manner similar to those of the antennas according to the first and second embodiments.

Figure 25A:
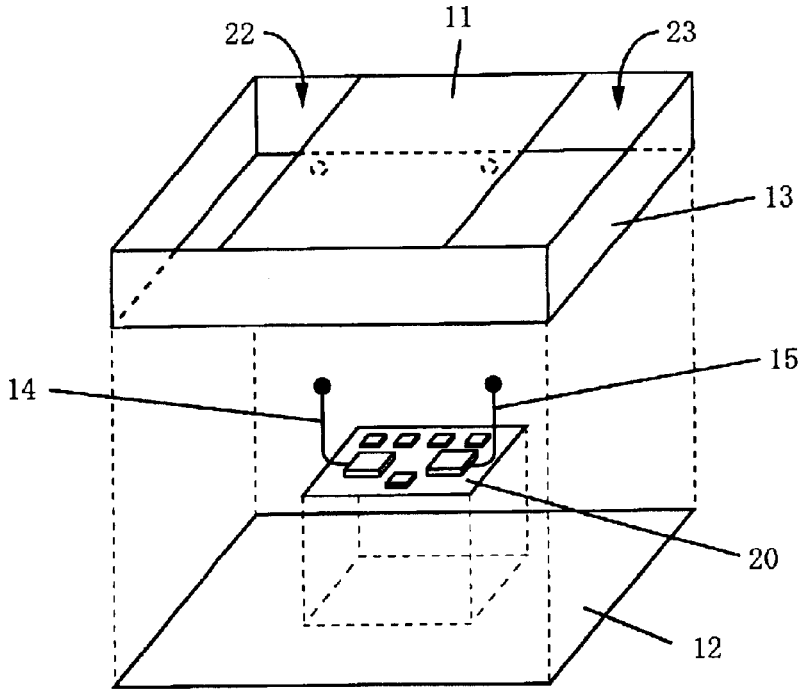
FIGS. 25A and 25B are illustrations showing first and second exemplary configurations, respectively, of the antenna according to a fourth embodiment of the present invention.
Figure 25B:
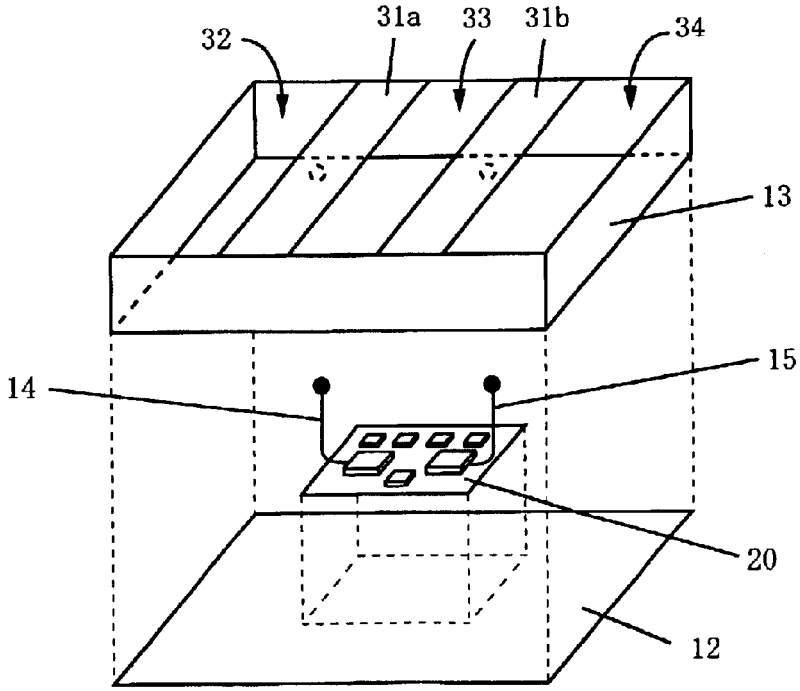

The antennas illustrated in FIGS. 25A and 25B are obtained by placing a power supply control circuit 20 inside of the antenna box of the antennas according to the first and second embodiments, respectively. In more detail, in these two antennas, a top conductor 11 (or top conductors 31*a* and 31*b*), a ground conductor 12, and side conductors 13 form an antenna box with the power supply control circuit 20 being placed therein. With this structure, the antenna can be made small in size.

Figure 26A:
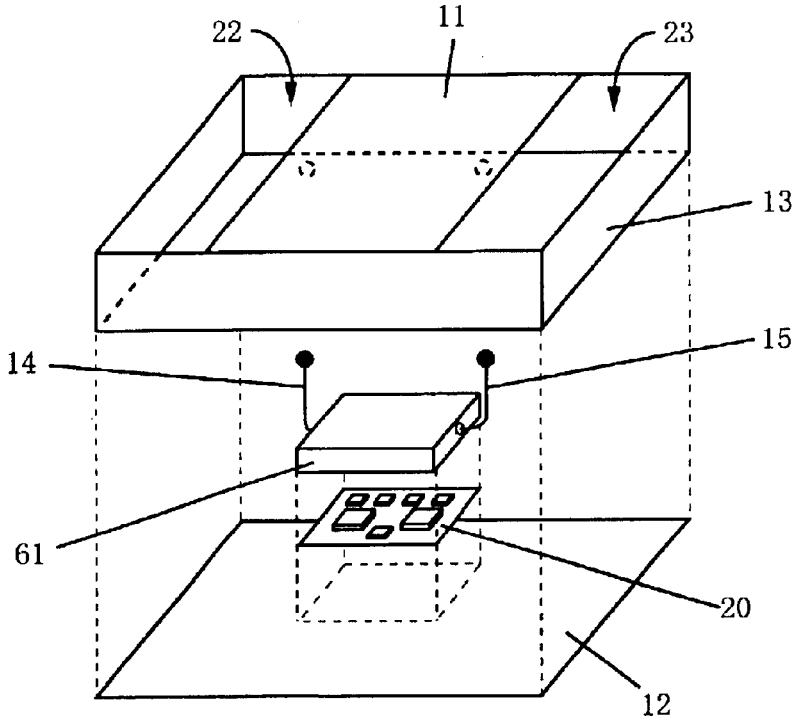
FIGS. 26A and 26B are illustrations showing third and fourth exemplary configurations, respectively, of the antenna according to the fourth embodiment of the present invention.
Figure 26B:
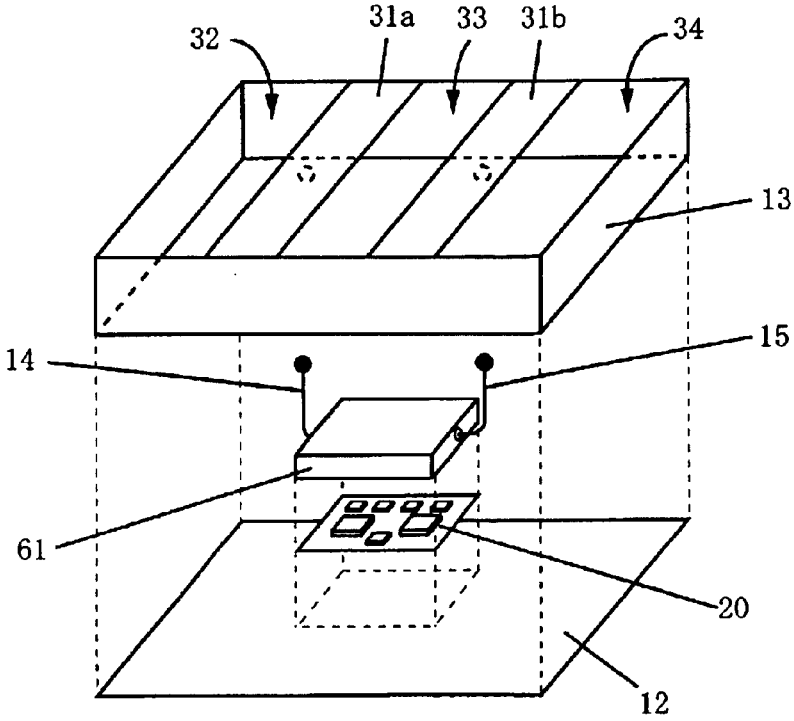

The antennas illustrated in FIGS. 26A and 26B are obtained by adding a shield material 61 for shielding the power supply control circuit 20 to the antennas in FIGS. 25A and 25B, respectively. In more detail, in these two antennas, the power supply control circuit 20 is placed on the ground conductor 12 inside of the antenna box with the metal shield material 61 shielding the power supply control circuit 20. In other words, the power supply control circuit 20 is placed in a space shielded by the ground conductor 12 and the shield material 61. With this, the antenna can be made small in size. Also, it is possible to reduce the influence of electric fields occurring inside of the antenna box on the operation of the power supply control circuit 20.

Figure 27A:
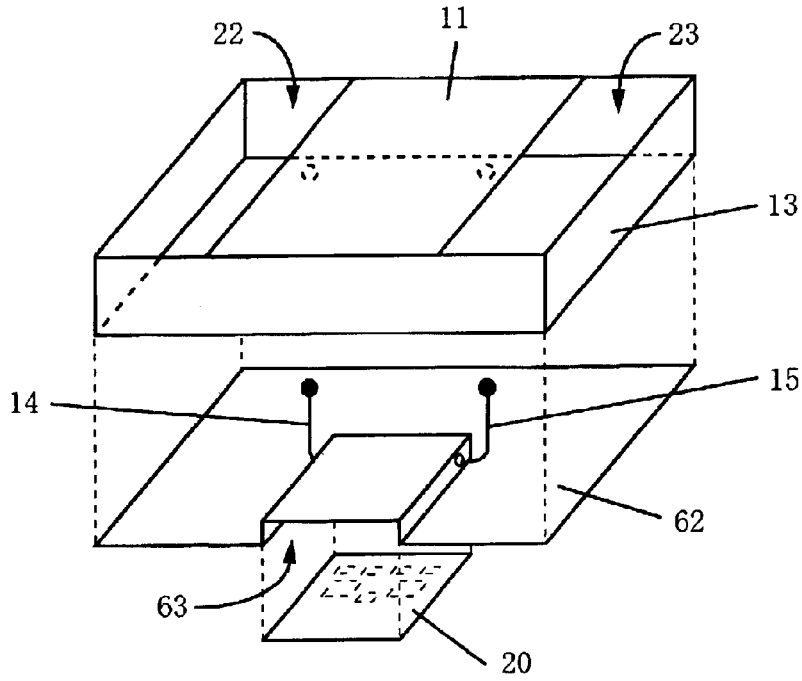
FIGS. 27A and 27B are illustrations showing fifth and sixth exemplary configurations, respectively, of the antenna according to the fourth embodiment of the present invention.
Figure 27B:
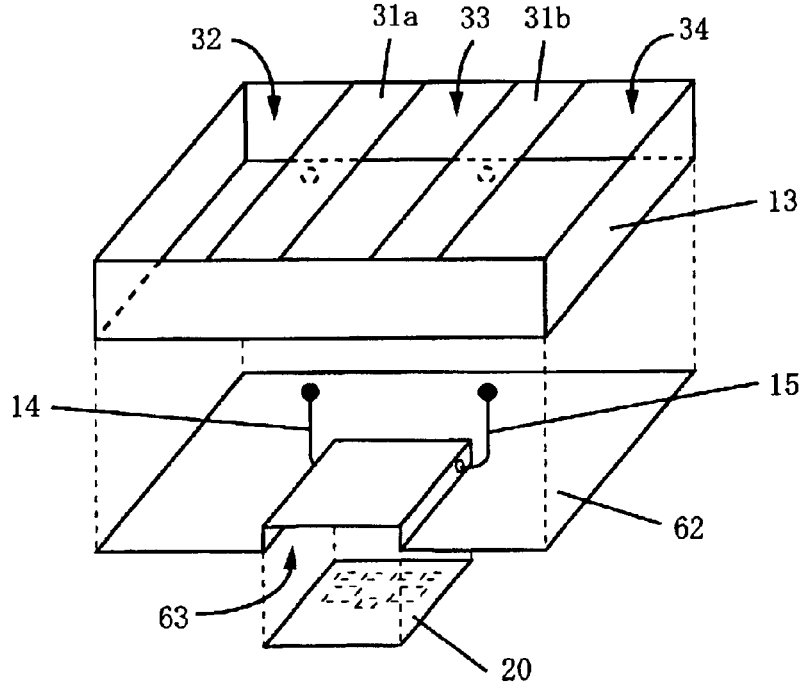

The antennas illustrated in FIGS. 27A and 27B are obtained by using a ground conductor 62 having a concave portion 63 and placing the power supply control circuit 20 in the concave portion 63 on the ground conductor 62. In more detail, in these two antennas, the ground conductor 62 having the concave portion 63 capable of accommodating the power supply control circuit 20 is used instead of a plate-shaped ground conductor. Such concave portion 63 is formed by, for example, stamping the metal ground conductor 62. When the top conductor 11 (or the top conductors 31*a* and 31*b*), the ground conductor 62, and the side conductors 13 form an antenna box, the ground conductor 62 is placed so that the concave portion 63 is oriented inwardly to the antenna box. Then, the power supply control circuit 20 is placed outside of the antenna box in the concave portion 63 on the ground conductor 62. With this, the antenna can be made small in size. Also, it is possible to reduce the influence of electric fields occurring inside of the antenna box on the operation of the power supply control circuit 20.

Figure 28A:
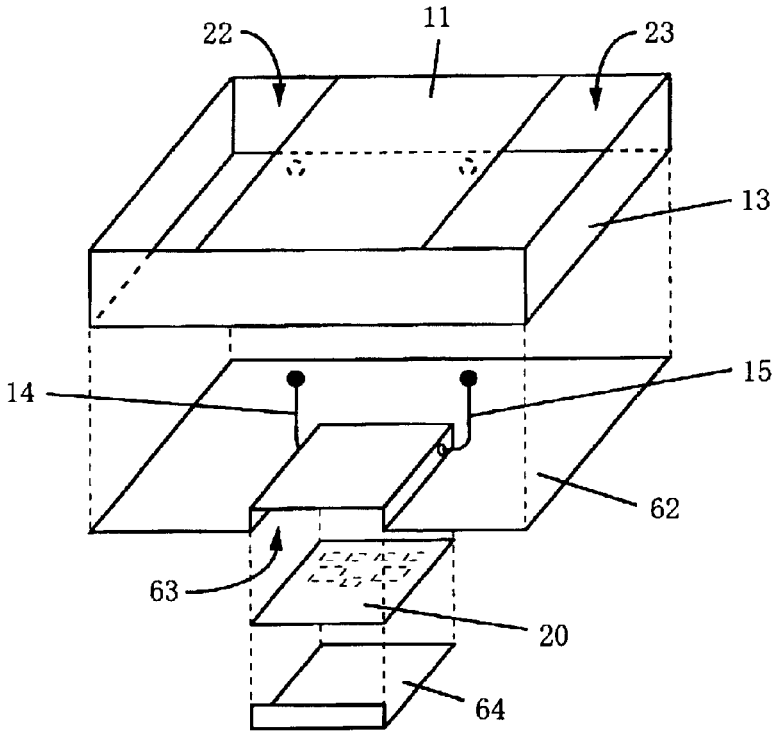
FIGS. 28A and 28B are illustrations showing seventh and eighth exemplary configurations, respectively, of the antenna according to the fourth embodiment of the present invention.
Figure 28B:
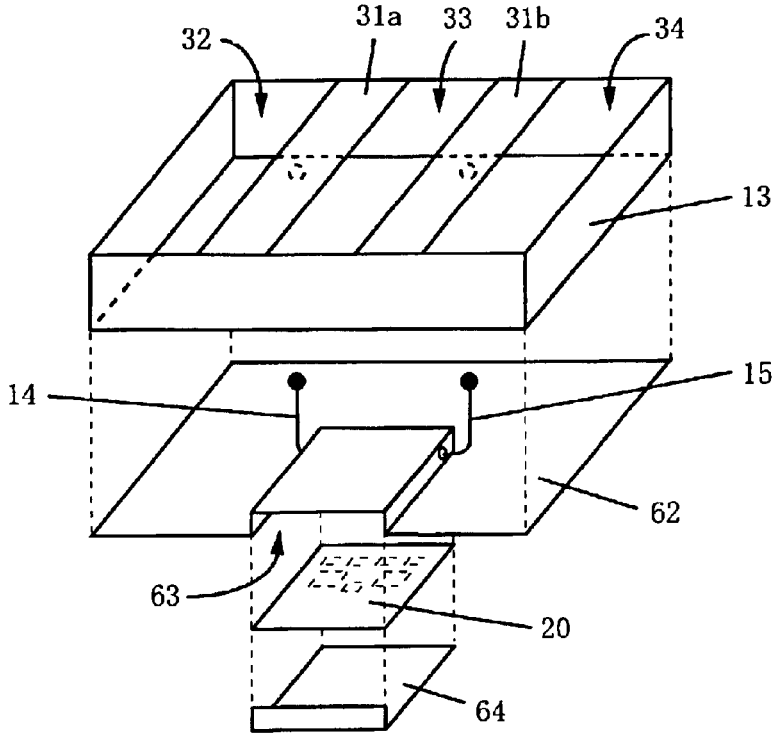

The antennas illustrated in FIGS. 28A and 28B are obtained by adding a shield material 64 for shielding the power supply control circuit 20 to the antennas illustrated in FIGS. 27A and 27B. In more detail, in these two antennas, the power supply control circuit 20 is placed outside of the antenna box in the concave portion 63 of the ground conductor 62, and the metal shield material 64 is placed so as to cover the concave portion 63. In other words, the power supply control circuit 20 is placed in a space shielded by the concave portion 63 of the ground conductor 62 and the shield material 64. With this, the antenna can be made small in size. Also, it is possible to further reduce the influence of electric fields occurring inside of the antenna box on the operation of the power supply control circuit 20.

Placing the power supply control circuit 20 in the above-described manner can be applied to the antenna according to the third embodiment as well as the antennas according to the first and second embodiments, and also to the antennas according to the modifications of the first through third embodiments. Also, the size and shape of the concave portion 63 of the ground conductor 62 can be arbitrary as long as the concave portion 63 can accommodate the power supply control circuit 20. Moreover, the type of material, shape, and size of the shield materials 61 and 64 can be arbitrary as long as the shield materials 61 and 64 has a predetermined shielding function to the electric fields occurring inside of the antenna box. For example, in the antennas illustrated in FIGS. 26A and 26B, the shield material 61 in use is shaped like a rectangular parallelepiped without a bottom surface. Alternatively, a plate-like shield material can be used.

As described above, according to the present embodiment, with the power supply control circuit placed inside of the antenna box or the concave portion of the ground conductor. With this, the antenna can be made small in size. Also, it is possible to further reduce the influence of electric fields occurring inside of the antenna box on the operation of the power supply control circuit.

(Fifth Embodiment)

Figure 29:
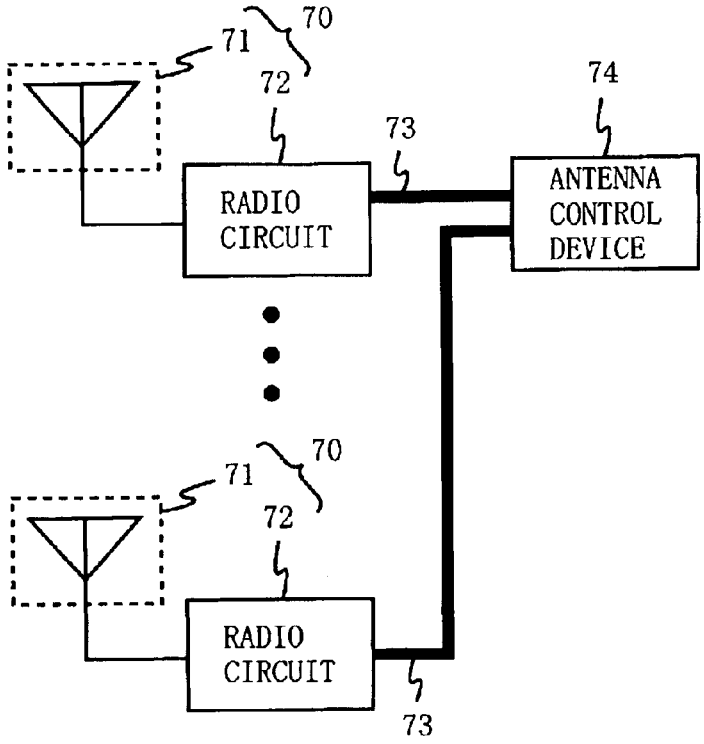
FIG. 29 is an illustration showing the general outlines of the configuration and the usage style of an antenna unit according to a fifth embodiment of the present invention.

In a fifth embodiment, an antenna unit using one of the antennas according to the first through fourth embodiments is described below. FIG. 29 is an illustration showing the general outlines of the configuration and the usage style of the antenna unit according to present embodiment. As illustrated in FIG. 29, each antenna unit 70 includes an antenna 71 and a radio circuit 72, and is connected via a communications cable 73 to an antenna control device 74. The antenna control device 74 typically transmits and receives a radio signal between the plurality of antenna units 70 placed at different locations. Between the antenna unit 70 and the antenna control device 74, electrical or optical communications are carried out.

FIGS. 30 through 35 are illustrations showing examples of the configuration of the antenna unit 70. In FIGS. 30 through 35, the antenna 71 is any one of the antennas according to first through fourth embodiments and the modifications of these embodiments. Radio circuits 72*a* through 72*e* each supply a radio signal received from the antenna control device 74 to an external connecting terminal (not shown) of the antenna 71, and transmit a radio signal output from the external connecting terminal of the antenna 71 to the antenna control device 74. The antenna 71 has already been described. Hereinafter, details of the radio circuits 72*a* through 72*e* are described.

Figure 30:
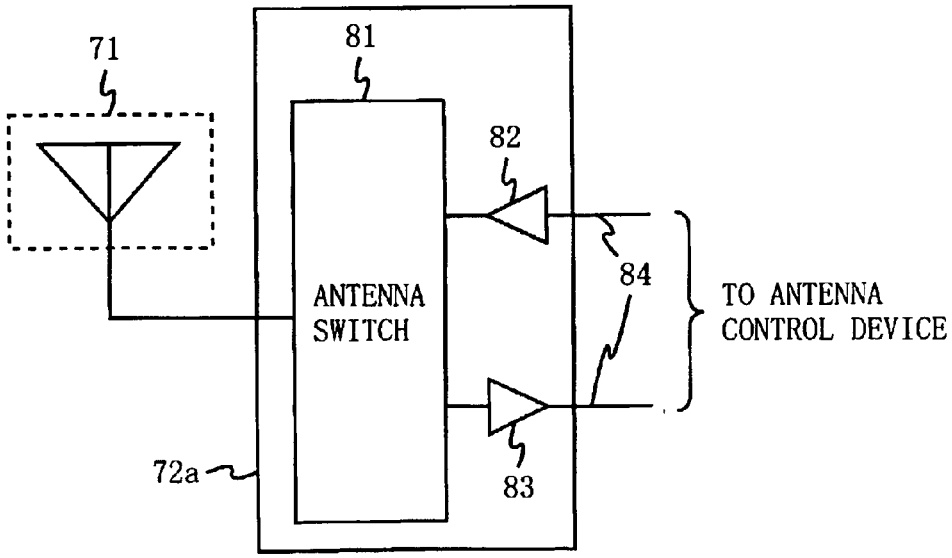
FIG. 30 is an illustration showing a first example of the configuration of the antenna unit according to the fifth embodiment of the present invention.

The radio circuit 72*a* illustrated in FIG. 30 includes an antenna switch 81 and amplifier circuits 82 and 83. The radio circuit 72*a* is connected via communications cables 84 for transmitting an electrical signal to an antenna control device (not shown). The amplifier circuit 82 amplifies a radio signal (electrical signal) received from the antenna control device for output to the antenna switch 81. The antenna switch 81 then supplies the radio signal output from the amplifier circuit 82 to the external connecting terminal (not shown) of the antenna 71. Also, the antenna switch 81 outputs a radio signal output from the external connecting terminal of the antenna 71 to the amplifier circuit 83. The amplifier circuit 83 then amplifies the radio signal (electrical signal) output from the antenna switch 81 for transmission to the antenna control device. With the above-structured radio circuit 72*a* and the antenna 71 being combined together, it is possible to provide an antenna unit including a small, slim, simply-structured antenna capable of biasing the directivity to a desired direction and controlling the directivity even after installation.

Figure 31:
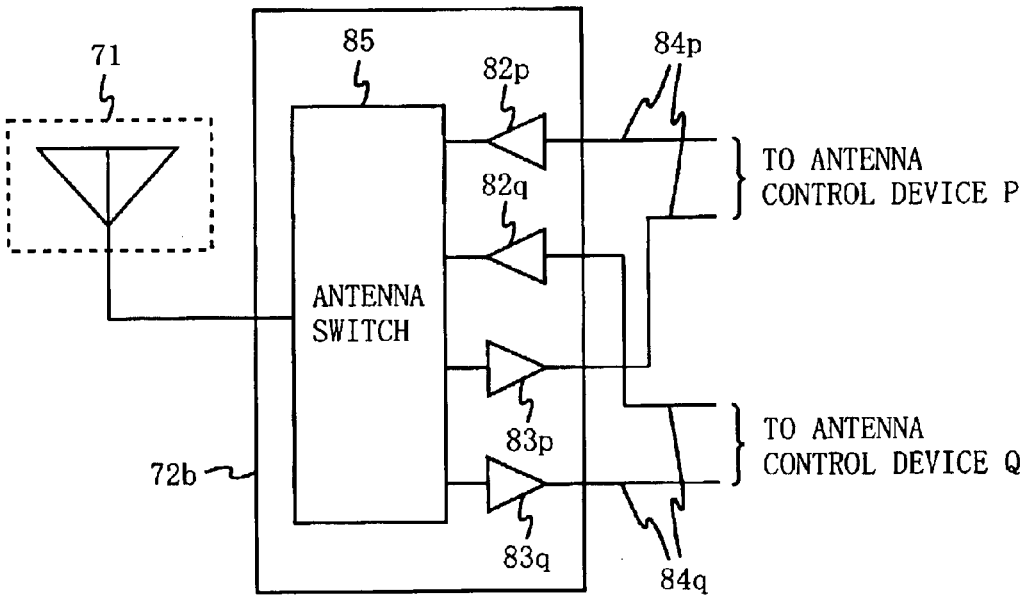
FIG. 31 is an illustration showing a second example of the configuration of the antenna unit according to the fifth embodiment of the present invention.

The radio circuit 72*b* illustrated in FIG. 31 includes an antenna switch 85 and amplifier circuits 82*p*, 82*q*, 83*p* and 83*q*. The radio circuit 72*b* is connected via communications cables 84*p* and 84*q* for transmitting an electrical signal to two antenna control devices P and Q (not shown). The amplifier circuit 82*p* amplifies a radio signal (electrical signal) received from the antenna control device P for output to the antenna switch 85. The amplifier circuit 83*p* amplifies a radio signal (electrical signal) output from the antenna switch 85 for transmission to the antenna control device P. The amplifier circuits 82*q* and 83*q* operate in a similar manner with respect to the antenna control device Q. The antenna switch 85 supplies a radio signal output from the amplifier circuit 82*p* or 82*q* to the external connecting terminal (not shown) of the antenna 71. Also, the antenna switch 85 supplies a radio signal output from the external connecting terminal of the antenna 71 to either one of the amplifier circuits 83*p* or 83*q* depending on the frequency of the received radio signal. With the above-structured radio circuit 72*b* and the antenna 71 being combined together, it is possible to provide an antenna unit including a small, slim, simply-structured antenna capable of biasing the directivity to a desired direction and controlling the directivity even after installation. Furthermore, this antenna unit enables communications with a plurality of antenna control devices.

Figure 32:
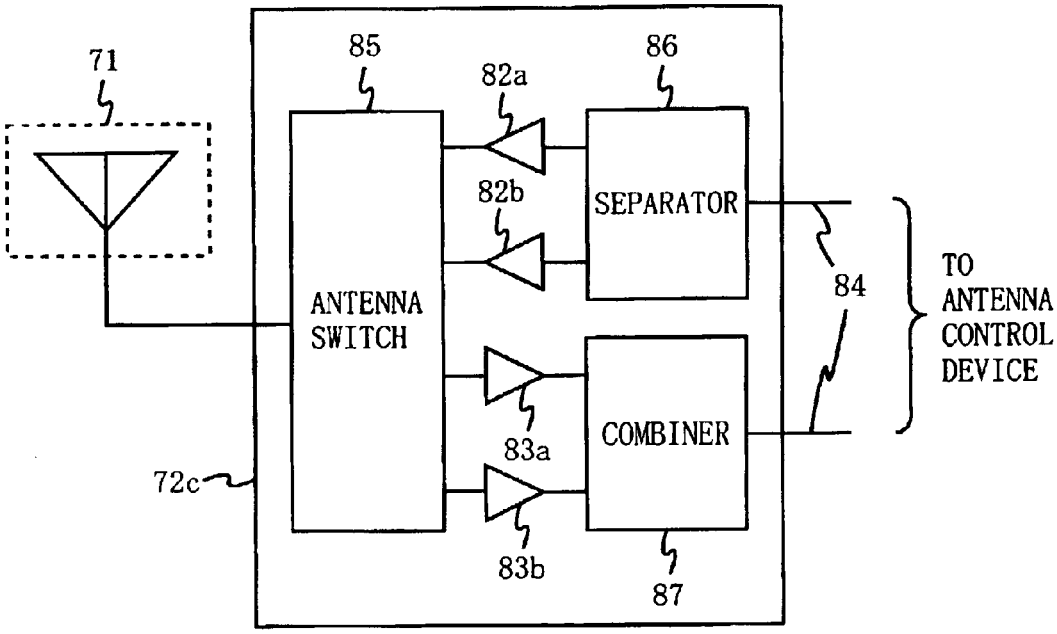
FIG. 32 is an illustration showing a third example of the configuration of the antenna unit according to the fifth embodiment of the present invention.

The radio circuit 72*c* illustrated in FIG. 32 includes an antenna switch 85, amplifier circuits 82*a*, 82*b*, 83*a* and 83*b*, a separator 86, and a combiner 87. The radio circuit 72*c* is connected via communications cables 84 for transmitting an electrical signal to an antenna control device (not shown). The separator 86 separates a radio signal (electrical signal) transmitted from the antenna control device into two signals for output to the amplifier circuits 82*a* and 82*b*, respectively. The amplifier circuits 82*a* and 82*b* then each amplify the electrical signal received from the separator 86 for output to the antenna switch 85. The antenna switch 85 operates in a manner similar to that in a case of the radio circuit 72*b* illustrated in FIG. 31. The amplifier circuits 83*a* and 83*b* each amplify a radio signal (electrical signal) output from the antenna switch 85 for output to the combiner 87. The combiner 87 then combines the radio signals output from the amplifier circuits 83*a* and 83*b* together for transmission to the antenna control device. With the above-structured radio circuit 72*c* and the antenna 71 being combined together, it is possible to provide an antenna unit including a small, slim, simply-structured antenna capable of biasing the directivity to a desired direction and controlling the directivity even after installation. Furthermore, this antenna unit can also handle a plurality of radio signals.

Figure 33:
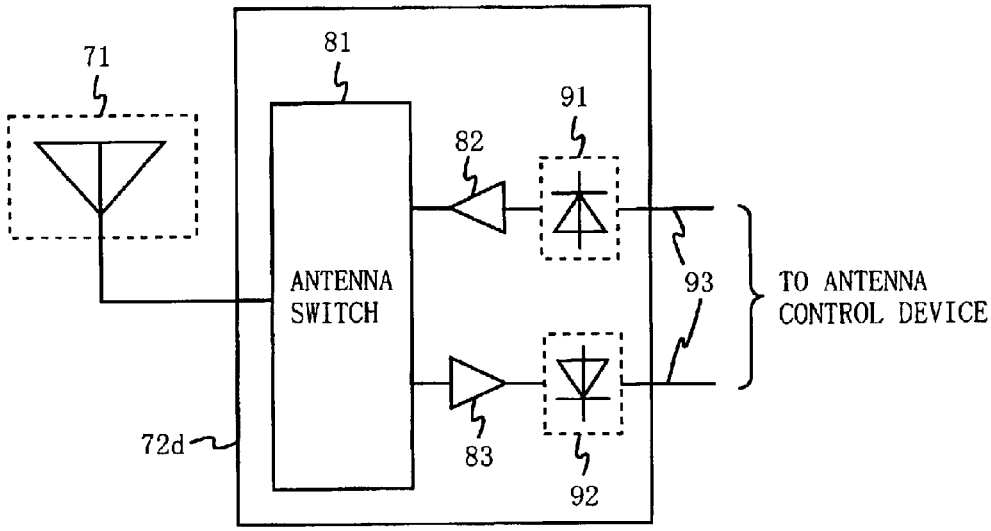
FIG. 33 is an illustration showing a fourth embodiment of the configuration of the antenna unit according to the fifth embodiment of the present invention.

The radio circuit 72*d* illustrated in FIG. 33 includes an antenna switch 81, amplifier circuits 82 and 83, a photodiode 91, and a laser 92. The radio circuit 72*d* is connected via optical fibers 93 to an antenna control device (not shown). The photodiode 91 and the laser 92 correspond to a converter circuit for converting an optical signal to an electrical signal and vice versa. The photodiode 91 receives a radio optical signal from the antenna control device, and converts the optical signal to a radio electrical signal. The laser 92 converts a radio electrical signal output from the amplifier circuit 83 to a radio optical signal. The radio circuit 72*d* operates in a manner similar to that of the radio circuit 72*a* illustrated in FIG. 30, except that optical communications are performed with the antenna control device by using the converter circuit composed of the photodiode 91 and the laser 92. With the above-structured radio circuit 72*d* and the antenna 71 being combined together, it is possible to provide an antenna unit including a small, slim, simply-structured antenna capable of biasing the directivity to a desired direction and controlling the directivity even after installation. Furthermore, this antenna unit enables optical communications with the antenna control device.

Figure 34:
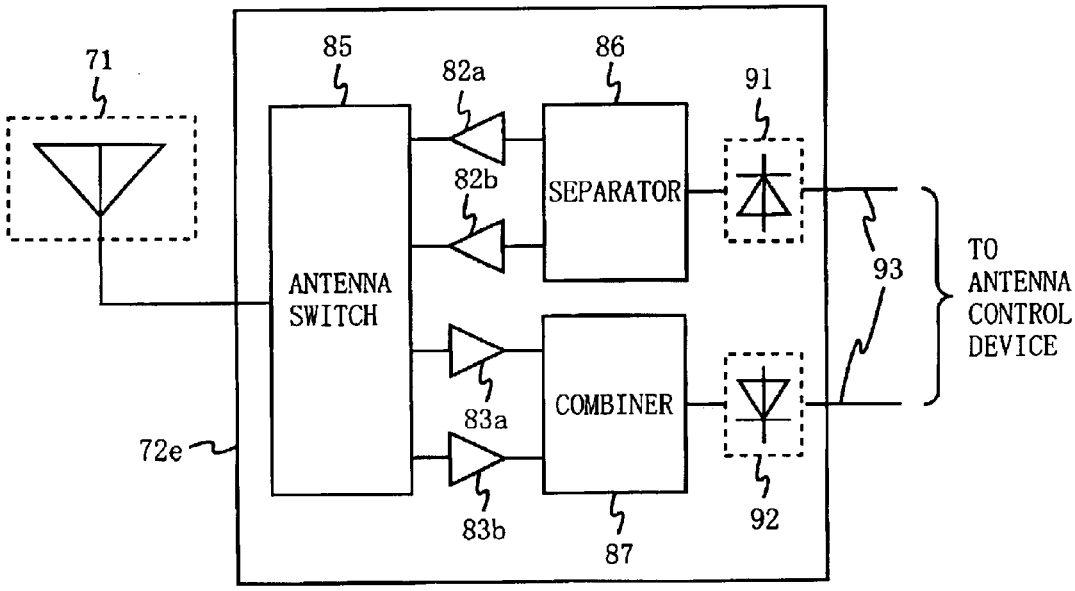
FIG. 34 is an illustration showing a fifth example of the configuration of the antenna unit according to the fifth embodiment of the present invention.
Figure 35:
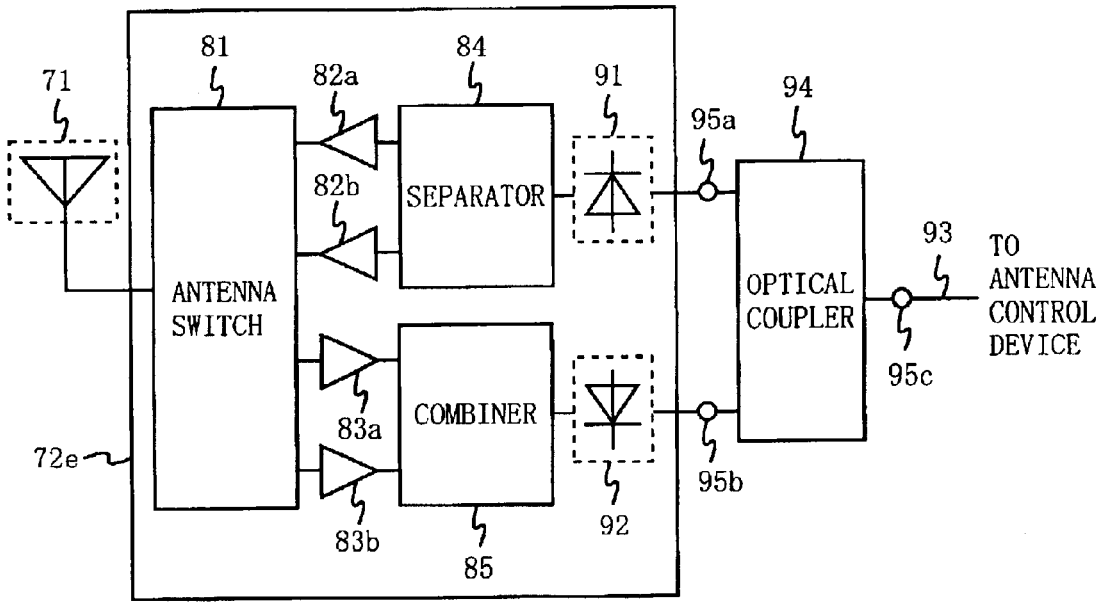
FIG. 35 is an illustration showing a sixth embodiment of the configuration of the antenna unit according to the fifth embodiment of the present invention.
Figure 36:
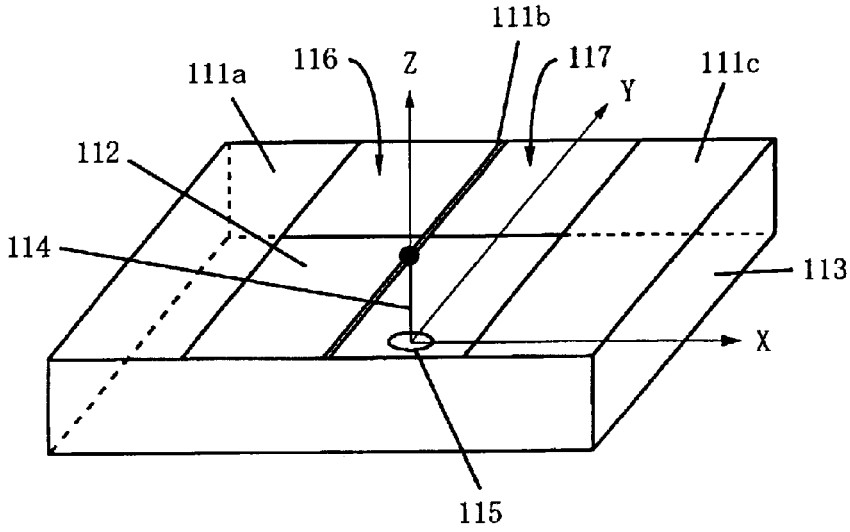
FIG. 36 PRIOR ART
FIG. 36 is an illustration showing the configuration of a conventional antenna.
Figure 37A:
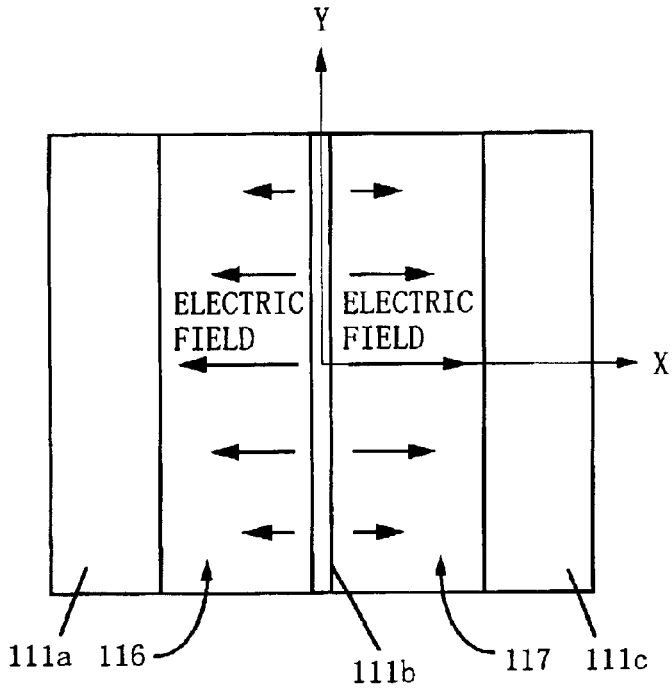
FIG. 37A PRIOR ART
FIG. 37 is an illustration showing the operational principle of the conventional antenna.
Figure 37B:
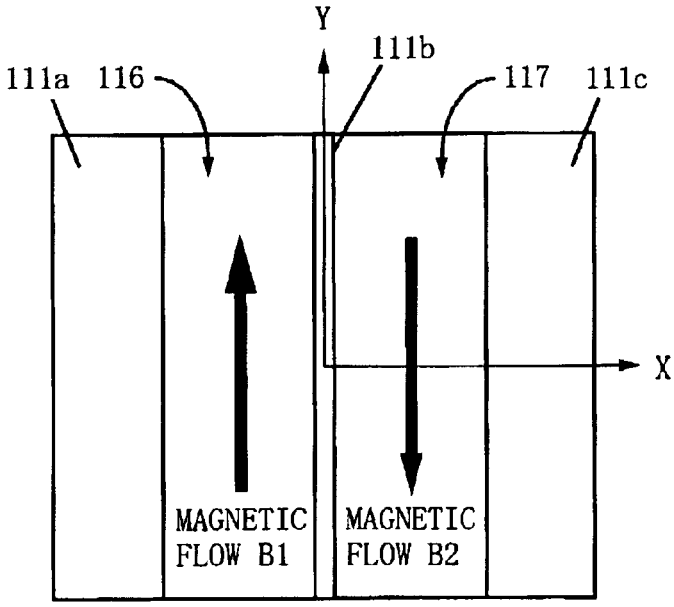
FIG. 37B PRIOR ART
Figure 38:
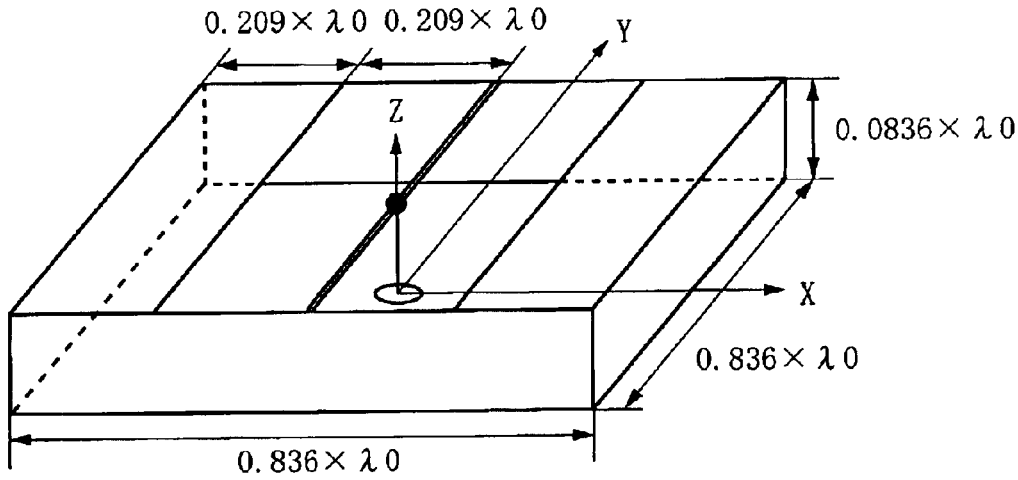
FIG. 38 PRIOR ART
FIG. 38 is an illustration showing the configuration of a prototype of the conventional antenna.
Figure 39:
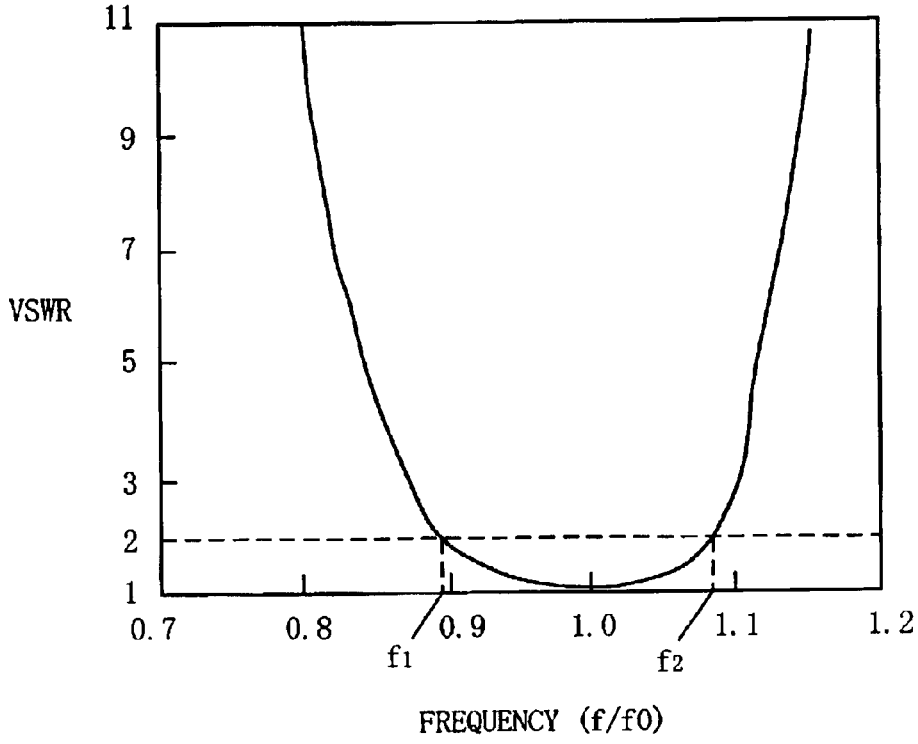
FIG. 39 PRIOR ART
FIG. 39 is an illustration showing the impedance characteristics of the prototype illustrated in FIG. 38.
Figure 40:
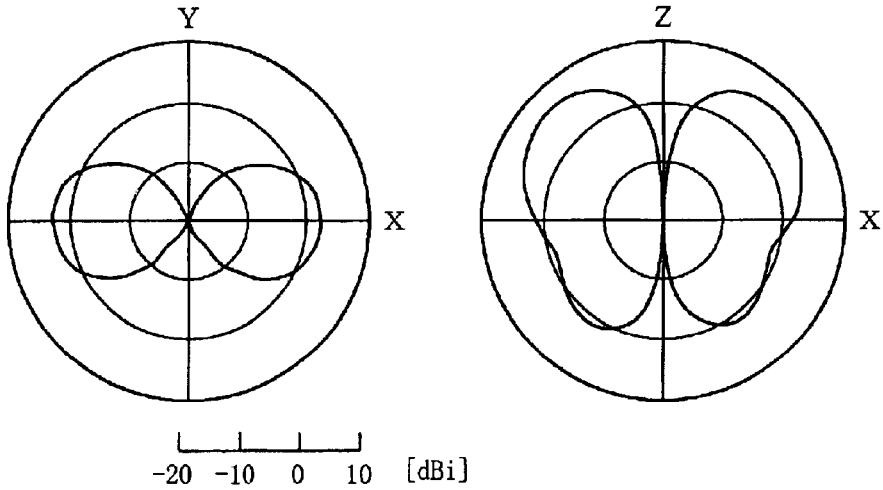
FIG. 40 PRIOR ART
FIG. 40 is an illustration showing the radiation characteristic of the prototype illustrated in FIG. 38.

The radio circuit 72*e* illustrated in FIG. 34 includes an antenna switch 85, amplifier circuits 82*a*, 82*b*, 83*a*, and 83*b*, a separator 86, a combiner 87, a photodiode 91, and a laser 92. The photodiode 91 and the laser 92 operate in a manner similar to that in a case of the radio circuit 72*d* illustrated in FIG. 33. The radio circuit 72*e* operates in a manner similar to that of the radio circuit 72*c* illustrated in FIG. 32, except that optical communications are performed with the antenna control device by using the converter circuit composed of the photodiode 91 and the laser 92. With the above-structured radio circuit 72*e* and the antenna 71 being combined together, it is possible to provide an antenna unit including a small, slim, simply-structured antenna capable of biasing the directivity to a desired direction and controlling the directivity even after installation. Furthermore, this antenna unit can also handle a plurality of radio signals, and also enables optical communications with the antenna control device.

The antenna unit can be provided with an optical coupler for bi-directional optical communications with the antenna control device. For example, with an optical coupler being inserted in an interfacing portion between the radio circuit 72*e* illustrated in FIG. 34 and the antenna control device, an antenna unit illustrated in FIG. 35 can be obtained. The antenna unit illustrated in FIG. 35 includes the antenna 71, the radio circuit 72*e*, and an optical coupler 94, and is connected via an optical fiber 93 to the antenna control device (not shown). The optical coupler 94 has three terminals 95*a*, 95*b*, and 95*c*. An optical signal supplied through the terminal 95*c* is output through the terminal 95*a*. An optical signal supplied through the terminal 95*b* is output through the terminal 95*c*. With the above-structured optical coupler 94, the radio circuit for optical communications, and the antenna 71 being combined together, it is possible to provide an antenna unit including a small, slim, simply-structured antenna capable of biasing the directivity to a desired direction and controlling the directivity even after installation. Furthermore, this antenna unit also enables bi-directional optical communications with the antenna control device.

As described above, according to the present embodiment, by combining any of the antennas according to the first through fourth embodiments and the modifications of the first through third embodiments and any of various radio circuits together, it is possible to provide an antenna unit including a small, slim, simply-structured antenna capable of biasing the directivity to a desired direction and controlling the directivity even after installation.

In short, the antennas according to the first through fourth embodiments and the modifications of those embodiments each include two or more antenna elements in a space enclosed by a top conductor(s), a ground conductor, and side conductors, and use a power supply control circuit to control signals passing through these antenna elements. With this, the antenna can be made small and slim. Also, the radiation directivity can be biased to a desired direction. Still also, the directivity of the antenna can be controlled even after installation. Furthermore, with any of these antennas and any of various radio circuits being combined together, it is possible to provide an antenna unit including an antenna having the above-described features.

While the invention has been described in detail, the foregoing description is in all aspects illustrative and not restrictive. It is understood that numerous other modifications and variations can be devised without departing from the scope of the invention.

What is claimed is:

1. An antenna with a directivity, comprising:

a ground conductor;

at least two power supply sections placed on a surface of the ground conductor;

at least two antenna elements connected one-to-one to the power supply sections;

a top conductor opposed to the ground conductor across the antenna elements;

side conductors surrounding a space including the antenna elements, being located apart from the antenna elements, and forming, together with the top conductor and the ground conductor, an antenna box having at least two openings; and a power supply control section for controlling signals passing through between an external connecting terminal and the power supply sections.

2. The antenna according to claim 1, wherein the power supply control section switches the power supply sections for connection to the external connecting terminal.

3. The antenna according to claim 1, wherein the power supply control section has at least either one of a function of combining signals supplied by the power supply sections for output to the external connecting terminal and a function of separating a signal supplied through the external connecting terminal for output.

4. The antenna according to claim 1, wherein the power supply control section includes a phase adjusting section, located at a point on a route from the external connecting terminal to one of the power supply sections, for changing a phase of the signal.

5. The antenna according to claim 1, wherein the power supply control section includes an amplitude adjusting section, located at a point on a route from the external connecting terminal to one of the power supply sections, for changing an amplitude of the signal.

6. The antenna according to claim 1, wherein only one said top conductor is provided, and all of the antenna elements are placed in a space between the top conductor and the ground conductor.

7. The antenna according to claim 1, wherein at least two of said top conductors are provided, and each of the antenna elements is placed in a space between each of the top conductors and the ground conductor.

8. The antenna according to claim 1, wherein the top conductor and the antenna elements are electrically connected to each other.

9. The antenna according to claim 1, wherein the antenna box, and shapes and locations of the openings are symmetrical with respect to a first plane which is perpendicular to the ground conductor.

10. The antenna according to claim 9, wherein the power supply sections are placed symmetrically with respect to the first plane.

11. The antenna according to claim 9, wherein the antenna box, and shapes and locations of the openings are symmetrical with respect to a second plane which is perpendicular to both of the ground conductor and the first plane.

12. The antenna according to claim 11, wherein the power supply sections are placed symmetrically with respect to the first plane and the second plane.

13. The antenna according to claim 1, wherein the ground conductor is in a shape of a rectangle.

14. The antenna according to claim 1, wherein the ground conductor is in a circular-like shape.

15. The antenna according to claim 1, further comprising at least one matching conductor which is accommodated in the antenna box, is electrically connected to the ground conductor, and is placed apart from the antenna elements.

16. The antenna according to claim 15, wherein the at least one matching conductor is electrically connected to the antenna elements.

17. The antenna according to claim 15, wherein the at least one matching conductor is electrically connected to the top conductor.

18. The antenna according to claim 1, further comprising at least one isolation adjusting conductor which is accommodated in the antenna box and is connected at one end to the ground conductor.

19. The antenna according to claim 18, wherein the at least one isolation adjusting conductor is connected to the top conductor.

20. The antenna according to claim 1, further comprising a dielectric material which is accommodated in the antenna box, wherein the dielectric material has a dielectric constant higher than a dielectric constant of air.

21. The antenna according to claim 20, wherein the antenna box is entirely filled with the dielectric material.

22. The antenna according to claim 21, wherein the top conductor and the ground conductor are formed by metal foils laminated to a dielectric plate, and the side conductors are formed with via holes.

23. The antenna according to claim 20, wherein the dielectric material occupies part of the inside of the antenna box, and covers the openings.

24. The antenna according to claim 1, further comprising an opening control section for changing a size of at least one of the openings.

25. The antenna according to claim 1, wherein the power supply control section is placed on the ground conductor inside of the antenna box.

26. The antenna according to claim 25, further comprising a shield material made of metal which is accommodated in the antenna box, wherein the power supply control section is placed in a space shielded by the ground conductor and the shield material.

27. The antenna according to claim 1, wherein the ground conductor has a concave portion oriented inwardly to the antenna box, and the power supply control section is placed in the concave portion of the ground conductor outside of the antenna box.

28. The antenna according to claim 27, further comprising a shield material made of metal which covers the concave portion of the ground conductor, wherein the power supply control section is placed in a space shielded by the concave portion of the ground conductor and the shield material.

29. An antenna unit including an antenna with a directivity, comprising:

a ground conductor;

at least two power supply sections placed on a surface of the ground conductor;

at least two antenna elements connected one-to-one to the power supply sections;

a top conductor opposed to the ground conductor across the antenna elements;

side conductors surrounding a space including the antenna elements, being located apart from the antenna elements, and forming, together with the top conductor and the ground conductor, an antenna box having at least two openings;

a power supply control section for controlling signals passing through between an external connecting terminal and the power supply sections; and a radio circuit for supplying the antenna connecting terminal with a radio signal received from an antenna control device externally provided, and transmitting a radio signal output from the antenna connecting terminal to the antenna control device.

30. The antenna unit according to claim 29, wherein the radio circuit includes a converter circuit for converting an optical signal to an electrical signal and an electrical signal to an optical signal, and performs optical communications with the antenna control device.

31. The antenna unit according to claim 29, wherein only one said top conductor is provided, and all of the antenna elements are placed in a space between the top conductor and the ground conductor.

32. The antenna unit according to claim 29, wherein at least two of said top conductors are provided, and each of the antenna elements is placed in a space between each of the top conductors and the ground conductor.

* * * * *